US007658977B2

(12) United States Patent
Wiszniewski et al.

(10) Patent No.: US 7,658,977 B2
(45) Date of Patent: Feb. 9, 2010

(54) METHOD OF FABRICATING INKJET PRINTHEAD HAVING PLANAR NOZZLE PLATE

(75) Inventors: Witold Roman Wiszniewski, Balmain (AU); David McLeod Johnstone, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 90 days.

(21) Appl. No.: 11/877,668

(22) Filed: Oct. 24, 2007

(65) Prior Publication Data

US 2009/0110846 A1 Apr. 30, 2009

(51) Int. Cl.
*H05H 1/24* (2006.01)

(52) U.S. Cl. ..... 427/569; 427/579; 427/256; 101/483; 347/47

(58) Field of Classification Search ..... 427/569, 427/534, 579, 256; 101/483; 347/47
See application file for complete search history.

(56) References Cited

U.S. PATENT DOCUMENTS

| | | | | |
|---|---|---|---|---|
| 6,310,641 | B1 * | 10/2001 | Mrvos et al. | 347/47 |
| 6,449,831 | B1 * | 9/2002 | Komplin et al. | 29/611 |
| 6,857,186 | B2 * | 2/2005 | Lin et al. | 29/890.1 |
| 6,959,979 | B2 * | 11/2005 | Goin et al. | 347/40 |
| 7,322,686 | B2 * | 1/2008 | Silverbrook | 347/87 |
| 2003/0141277 | A1 | 7/2003 | Beatty et al. | |
| 2003/0231227 | A1 * | 12/2003 | Kim | 347/63 |
| 2004/0035823 | A1 | 2/2004 | Min et al. | |
| 2005/0134646 | A1 * | 6/2005 | Huang et al. | 347/54 |
| 2006/0001698 | A1 * | 1/2006 | Hart et al. | 347/40 |
| 2007/0040870 | A1 * | 2/2007 | Lu et al. | 347/68 |
| 2007/0080989 | A1 * | 4/2007 | Silverbrook | 347/29 |
| 2007/0081032 | A1 | 4/2007 | Silverbrook | |
| 2007/0120889 | A1 * | 5/2007 | Kang et al. | 347/45 |
| 2008/0088676 | A1 * | 4/2008 | Silverbrook | 347/61 |
| 2008/0129780 | A1 * | 6/2008 | Cha et al. | 347/45 |
| 2008/0284821 | A1 * | 11/2008 | Silverbrook et al. | 347/47 |
| 2008/0297566 | A1 * | 12/2008 | McAvoy et al. | 347/56 |

FOREIGN PATENT DOCUMENTS

| | | | |
|---|---|---|---|
| EP | 0999055 | A | 5/2000 |
| EP | 1652674 | A2 * | 5/2006 |
| WO | WO 2004/096557 | A1 * | 11/2004 |

OTHER PUBLICATIONS

Shen, S.C., et al., "Fabrication of integrated nozzle plates for inkjet print head using microinjection process". Sensors and Actuators A 127 (2006) pp. 241-247.*

Lee, Jae-Duk, et al., "A Thermal Inkject Printhead with a Monolithically Fabricated Nozzle Plate and Self-Aligned Ink Feed Hole". Journal of Microelectromechanical Systems, vol. 8, No. 3, Sep. 1999, pp. 229-236.*

* cited by examiner

*Primary Examiner*—Bret Chen

(57) ABSTRACT

A method of fabricating an inkjet printhead is provided. The method comprises the steps of: (a) providing a partially-fabricated printhead having a first nozzle plate comprised of a first material spanning a plurality of nozzles, the first nozzle plate having a plurality of cavities; (b) filling the cavities with a filler, such that an upper surface of the first nozzle plate and an upper surface of the filler together define a contiguous planar surface; and (c) depositing a second material onto the planar surface to form a second nozzle plate having a planar exterior surface.

11 Claims, 25 Drawing Sheets

METHOD OF FABRICATING INKJET PRINTHEAD HAVING PLANAR NOZZLE PLATE

CO-PENDING APPLICATIONS

The following application has been filed by the Applicant simultaneously with the present application:

MPN013US

The disclosure of this co-pending application is incorporated herein by reference. The above application has been identified by its filing docket number, which will be substituted with the corresponding application number, once assigned.

CROSS REFERENCES TO RELATED APPLICATIONS

Various methods, systems and apparatus relating to the present invention are disclosed in the following US Patents/Patent Applications filed by the applicant or assignee of the present invention:

| | | | | | | |
|---|---|---|---|---|---|---|
| 6,276,850 | 6,520,631 | 6,158,907 | 6,539,180 | 6,270,177 | 6,405,055 | 6,628,430 |
| 6,835,135 | 6,626,529 | 6,981,769 | 7,125,338 | 7,125,337 | 7,136,186 | 10/920,372 |
| 7,145,689 | 7,130,075 | 7,081,974 | 7,177,055 | 7,209,257 | 6,443,555 | 7,161,715 |
| 7,154,632 | 7,158,258 | 7,148,993 | 7,075,684 | 10/943,905 | 10/943,906 | 10/943,904 |
| 10/943,903 | 10/943,902 | 6,966,659 | 6,988,841 | 7,077,748 | 7,255,646 | 7,070,270 |
| 7,014,307 | 7,158,809 | 7,217,048 | 11/225,172 | 11/255,942 | 11/329,039 | 11/329,040 |
| 7,271,829 | 11/442,189 | 11/474,280 | 11/483,061 | 11/503,078 | 11/520,735 | 11/505,858 |
| 11/525,850 | 11/583,870 | 11/592,983 | 11/592,208 | 11/601,828 | 11/635,482 | 11/635,526 |
| 10/466,440 | 7,215,441 | 11/650,545 | 11/653,241 | 11/653,240 | 7,056,040 | 6,942,334 |
| 11/706,300 | 11/740,265 | 11/737,720 | 11/739,056 | 11/740,204 | 11/740,223 | 11/753,557 |
| 11/750,285 | 11758,648 | 11/778,559 | 11834,634 | 11/838,878 | 11845,669 | 6,799,853 |
| 7,237,896 | 6,749,301 | 10/451,722 | 7,137,678 | 7,252,379 | 7,144,107 | 10/503,900 |
| 10/503,898 | 10/503,897 | 7,220,068 | 7,270,410 | 7,241,005 | 7,108,437 | 7,140,792 |
| 10/503,922 | 7,224,274 | 10/503,917 | 10/503,918 | 10/503,925 | 10/503,927 | 10/503,928 |
| 10/503,929 | 10/503,885 | 7,195,325 | 7,229,164 | 7,150,523 | 10/503,889 | 7,154,580 |
| 6,906,778 | 7,167,158 | 7,128,269 | 6,688,528 | 6,986,613 | 6,641,315 | 7,278,702 |
| 10/503,891 | 7,150,524 | 7,155,395 | 6,915,140 | 6,999,206 | 6,795,651 | 6,883,910 |
| 7,118,481 | 7,136,198 | 7,092,130 | 6,786,661 | 6,808,325 | 10/920,368 | 10/920,284 |
| 7,219,990 | 10/920,283 | 6,750,901 | 6,476,863 | 6,788,336 | 6,322,181 | 6,597,817 |
| 6,227,648 | 6,727,948 | 6,690,419 | 10/470,947 | 6,619,654 | 6,969,145 | 6,679,582 |
| 10/470,942 | 6,568,670 | 6,866,373 | 7,280,247 | 7,008,044 | 6,742,871 | 6,966,628 |
| 6,644,781 | 6,969,143 | 6,767,076 | 6,834,933 | 6,692,113 | 6,913,344 | 6,727,951 |
| 7,128,395 | 7,036,911 | 7,032,995 | 6,969,151 | 6,955,424 | 6,969,162 | 10/919,249 |
| 6,942,315 | 11/006,577 | 7,234,797 | 6,986,563 | 11/063,577 | 11/045,442 | 11/124,044 |
| 7,283,159 | 7,077,330 | 6,196,541 | 11/149,389 | 11/185,725 | 7,226,144 | 11/202,344 |
| 7,267,428 | 11/248,423 | 11/248,422 | 7,093,929 | 11/282,769 | 11/330,060 | 11/442,111 |
| 11/472,406 | 11/499,806 | 11/499,710 | 6,195,150 | 11749,156 | 11782,588 | 11/854,435 |
| 11/853,817 | 6,362,868 | 6,831,681 | 6,431,669 | 6,362,869 | 6,472,052 | 6,356,715 |
| 6,894,694 | 6,636,216 | 6,366,693 | 6,329,990 | 6,459,495 | 6,137,500 | 6,690,416 |
| 7,050,143 | 6,398,328 | 7,110,024 | 6,431,704 | 6,879,341 | 6,415,054 | 6,665,454 |
| 6,542,645 | 6,486,886 | 6,381,361 | 6,317,192 | 6,850,274 | 09/113,054 | 6,646,757 |
| 6,624,848 | 6,357,135 | 6,271,931 | 6,353,772 | 6,106,147 | 6,665,008 | 6,304,291 |
| 6,305,770 | 6,289,262 | 6,315,200 | 6,217,165 | 6,496,654 | 6,859,225 | 6,924,835 |
| 6,647,369 | 6,943,830 | 09/693,317 | 7,021,745 | 6,712,453 | 6,460,971 | 6,428,147 |
| 6,416,170 | 6,402,300 | 6,464,340 | 6,612,687 | 6,412,912 | 6,447,099 | 6,837,567 |
| 6,505,913 | 7,128,845 | 6,733,684 | 7,249,108 | 6,566,858 | 6,331,946 | 6,246,970 |
| 6,442,525 | 09/517,384 | 09/505,951 | 6,374,354 | 7,246,098 | 6,816,968 | 6,757,832 |
| 6,334,190 | 6,745,331 | 7,249,109 | 10/203,559 | 7,197,642 | 7,093,139 | 10/636,263 |
| 10/636,283 | 10/866,608 | 7,210,038 | 10/902,883 | 10/940,653 | 10/942,858 | 11/706,329 |
| 11/757,385 | 11/758,642 | 7,119,836 | 7,283,162 | 10/642,331 | 10/636,285 | 7,170,652 |
| 6,967,750 | 6,995,876 | 7,099,051 | 7,172,191 | 7,243,916 | 7,222,845 | 11/239,232 |
| 11/055,276 | 7,063,940 | 11/107,942 | 7,193,734 | 7,086,724 | 7,090,337 | 7,278,723 |
| 7,140,717 | 11/190,902 | 11/209,711 | 7,256,824 | 7,140,726 | 7,156,512 | 7,186,499 |
| 11/478,585 | 11/525,862 | 11/540,574 | 11/583,875 | 11/592,181 | 6,750,944 | 11/599,336 |
| 11/650,548 | 11744,183 | 11/758,646 | 11/778,561 | 11/839,532 | 11/838,874 | 11/853,021 |
| 11/869,710 | 11/868,531 | 10/636,225 | 10/510,094 | 6,985,207 | 6,773,874 | 6,650,836 |
| 10/666,495 | 10/636,224 | 7,250,975 | 10/636,214 | 6,880,929 | 7,236,188 | 7,236,187 |
| 7,155,394 | 10/636,219 | 10/636,223 | 7,055,927 | 6,986,562 | 7,052,103 | 10/656,469 |
| 10/656,281 | 10/656,791 | 10/666,124 | 10/683,217 | 10/683,197 | 7,095,533 | 6,914,686 |
| 6,896,252 | 6,820,871 | 6,834,851 | 6,848,686 | 6,830,246 | 6,851,671 | 10/729,098 |
| 7,092,011 | 7,187,404 | 10/729,159 | 10/753,458 | 6,878,299 | 6,929,348 | 6,921,154 |
| 10/780,625 | 10/804,042 | 6,913,346 | 10/831,238 | 10/831,237 | 10/831,239 | 10/831,240 |
| 10/831,241 | 10/831,234 | 10/831,233 | 7,246,897 | 7,077,515 | 10/831,235 | 10/853,336 |
| 10/853,659 | 10/853,681 | 6,913,875 | 7,021,758 | 7,033,017 | 7,161,709 | 7,099,033 |
| 7,147,294 | 7,156,494 | 11/012,024 | 11/011,925 | 7,032,998 | 7,044,585 | 11/007,250 |
| 6,994,424 | 11/006,787 | 7,258,435 | 7,097,263 | 7,001,012 | 7,004,568 | 7,040,738 |
| 7,188,933 | 7,027,080 | 7,025,446 | 6,991,321 | 7,131,715 | 7,261,392 | 7,207,647 |
| 7,182,435 | 7,097,285 | 11/228,410 | 7,097,284 | 7,083,264 | 7,147,304 | 7,232,203 |
| 7,156,498 | 7,201,471 | 11/501,772 | 11/503,084 | 11/513,073 | 7,210,764 | 11/635,524 |
| 11/706,379 | 11/730,386 | 11/730,784 | 11/753,568 | 11/782,591 | 11/859,783 | 6,710,457 |
| 6,775,906 | 6,507,099 | 7,221,043 | 7,107,674 | 7,154,172 | 11/442,400 | 7,247,941 |
| 11/736,540 | 11/758,644 | 6,530,339 | 6,631,897 | 6,851,667 | 6,830,243 | 6,860,479 |
| 6,997,452 | 7,000,913 | 7,204,482 | 11/212,759 | 11/281,679 | 11/730,409 | 6,238,044 |
| 6,425,661 | 11/003,786 | 7,258,417 | 11/003,418 | 11/003,334 | 7,270,395 | 11/003,404 |

-continued

| | | | | | | |
|---|---|---|---|---|---|---|
| 11/003,419 | 11/003,700 | 7,255,419 | 11/003,618 | 7,229,148 | 7,258,416 | 7,273,263 |
| 7,270,393 | 6,984,017 | 11/003,699 | 11/071,473 | 7,156,497 | 11/601,670 | 11748,482 |
| 11/778,563 | 11/779,851 | 11/778,574 | 11/853,816 | 11/853,814 | 11/853,786 | 11/872,037 |
| 11/856,694 | 11/003,463 | 11/003,701 | 11/003,683 | 11/003,614 | 11/003,702 | 11/003,684 |
| 7,246,875 | 11/003,617 | 11/764,760 | 11,853,777 | 11/293,800 | 11/293,802 | 11/293,801 |
| 11/293,808 | 11/293,809 | 11/482,975 | 11/482,970 | 11/482,968 | 11/482,972 | 11/482,971 |
| 11/482,969 | 6,431,777 | 6,334,664 | 6,447,113 | 7,239,407 | 6,398,359 | 6,652,089 |
| 6,652,090 | 7,057,759 | 6,631,986 | 7,187,470 | 7,280,235 | 11/501,775 | 11,744,210 |
| 11/859,784 | 6,471,331 | 6,676,250 | 6,347,864 | 6,439,704 | 6,425,700 | 6,588,952 |
| 6,626,515 | 6,722,758 | 6,871,937 | 11/060,803 | 11/097,266 | 11/097,267 | 11/685,084 |
| 11/685,086 | 11/685,090 | 11/740,925 | 11/763,444 | 11/763,443 | 7,249,942 | 7,206,654 |
| 7,162,324 | 7,162,325 | 7,231,275 | 7,146,236 | 7,278,847 | 10/753,499 | 6,997,698 |
| 7,220,112 | 7,231,276 | 10/753,440 | 7,220,115 | 7,195,475 | 7,144,242 | 11/499,746 |
| 11/501,774 | 11/525,858 | 11/545,501 | 11/599,335 | 11/706,380 | 11736,545 | 11/736,554 |
| 11/739,047 | 11749,159 | 11/739,073 | 11/775,160 | 11/853,755 | 6,786,420 | 6,827,282 |
| 6,948,661 | 7,073,713 | 10/983,060 | 7,093,762 | 7,083,108 | 7,222,799 | 7,201,319 |
| 11/442,103 | 11/739,071 | 11/518,238 | 11/518,280 | 11/518,244 | 11/518,243 | 11/518,242 |
| 7,032,899 | 6,854,724 | 11/084,237 | 11/084,240 | 11/084,238 | 11/357,296 | 11/357,298 |
| 11/357,297 | 6,350,023 | 6,318,849 | 6,592,207 | 6,439,699 | 6,312,114 | 11/246,676 |
| 11/246,677 | 11/246,678 | 11/246,679 | 11/246,680 | 11/246,681 | 11/246,714 | 11/246,713 |
| 11/246,689 | 11/246,671 | 11/246,670 | 11/246,669 | 11/246,704 | 11/246,710 | 11/246,688 |
| 11/246,716 | 11/246,715 | 11/246,707 | 11/246,706 | 11/246,705 | 11/246,708 | 11/246,693 |
| 11/246,692 | 11/246,696 | 11/246,695 | 11/246,694 | 11/482,958 | 11/482,955 | 11/482,962 |
| 11/482,963 | 11/482,956 | 11/482,954 | 11/482,974 | 11/482,957 | 11/482,987 | 11/482,959 |
| 11/482,960 | 11/482,961 | 11/482,964 | 11/482,965 | 11/482,976 | 11/482,973 | 11/495,815 |
| 11/495,816 | 11/495,817 | 10/803,074 | 10/803,073 | 7,040,823 | 10/803,076 | 10/803,077 |
| 10/803,078 | 10/803,079 | 10/922,971 | 10/922,970 | 10/922,836 | 10/922,842 | 10/922,848 |
| 10/922,843 | 7,125,185 | 7,229,226 | 11/513,386 | 11/753,559 | 10/815,621 | 7,243,835 |
| 10/815,630 | 10/815,637 | 10/815,638 | 7,251,050 | 10/815,642 | 7,097,094 | 7,137,549 |
| 10/815,618 | 7,156,292 | 11738,974 | 10/815,635 | 10/815,647 | 10/815,634 | 7,137,566 |
| 7,131,596 | 7,128,265 | 7,207,485 | 7,197,374 | 7,175,089 | 10/815,617 | 10/815,620 |
| 7,178,719 | 10/815,613 | 7,207,483 | 10/815,619 | 7,270,266 | 10/815,614 | 11/446,240 |
| 11/488,162 | 11/488,163 | 11/488,164 | 11/488,167 | 11/488,168 | 11/488,165 | 11/488,166 |
| 7,267,273 | 11/834,628 | 11/839,497 | 10/815,636 | 7,128,270 | 11/041,650 | 11/041,651 |
| 11/041,652 | 11/041,649 | 11/041,610 | 11863,253 | 11863,255 | 11/863,257 | 11,863,258 |
| 11,863,262 | 11/041,609 | 11/041,626 | 11/041,627 | 11/041,624 | 11/041,625 | 11863,268 |
| 11,863,269 | 11,863,270 | 11,863,271 | 11,863,273 | 76,584,733 | 11/041,556 | 11/041,580 |
| 11/041,723 | 11/041,698 | 11/041,648 | 11,863,263 | 11,863,264 | 11,863,265 | 11,863,266 |
| 11,863,267 | 10/815,609 | 7,150,398 | 7,159,777 | 10/815,610 | 7,188,769 | 7,097,106 |
| 7,070,110 | 7,243,849 | 11/442,381 | 11/480,957 | 11/764,694 | 6,227,652 | 6,213,588 |
| 6,213,589 | 6,231,163 | 6,247,795 | 6,394,581 | 6,244,691 | 6,257,704 | 6,416,168 |
| 6,220,694 | 6,257,705 | 6,247,794 | 6,234,610 | 6,247,793 | 6,264,306 | 6,241,342 |
| 6,247,792 | 6,264,307 | 6,254,220 | 6,234,611 | 6,302,528 | 6,283,582 | 6,239,821 |
| 6,338,547 | 6,247,796 | 6,557,977 | 6,390,603 | 6,362,843 | 6,293,653 | 6,312,107 |
| 6,227,653 | 6,234,609 | 6,238,040 | 6,188,415 | 6,227,654 | 6,209,989 | 6,247,791 |
| 6,336,710 | 6,217,153 | 6,416,167 | 6,243,113 | 6,283,581 | 6,247,790 | 6,260,953 |
| 6,267,469 | 6,588,882 | 6,742,873 | 6,918,655 | 6,547,371 | 6,938,989 | 6,598,964 |
| 6,923,526 | 6,273,544 | 6,309,048 | 6,420,196 | 6,443,558 | 6,439,689 | 6,378,989 |
| 6,848,181 | 6,634,735 | 6,299,289 | 6,299,290 | 6,425,654 | 6,902,255 | 6,623,101 |
| 6,406,129 | 6,505,916 | 6,457,809 | 6,550,895 | 6,457,812 | 7,152,962 | 6,428,133 |
| 7,216,956 | 7,080,895 | 11/144,844 | 7,182,437 | 11/599,341 | 11/635,533 | 11/607,976 |
| 11/607,975 | 11/607,999 | 11/607,980 | 11/607,979 | 11/607,978 | 11/735,961 | 11/685,074 |
| 11/696,126 | 11/696,144 | 11/696,650 | 11/763,446 | 6,224,780 | 6,235,212 | 6,280,643 |
| 6,284,147 | 6,214,244 | 6,071,750 | 6,267,905 | 6,251,298 | 6,258,285 | 6,225,138 |
| 6,241,904 | 6,299,786 | 6,866,789 | 6,231,773 | 6,190,931 | 6,248,249 | 6,290,862 |
| 6,241,906 | 6,565,762 | 6,241,905 | 6,451,216 | 6,231,772 | 6,274,056 | 6,290,861 |
| 6,248,248 | 6,306,671 | 6,331,258 | 6,110,754 | 6,294,101 | 6,416,679 | 6,264,849 |
| 6,254,793 | 6,245,246 | 6,855,264 | 6,235,211 | 6,491,833 | 6,264,850 | 6,258,284 |
| 6,312,615 | 6,228,668 | 6,180,427 | 6,171,875 | 6,267,904 | 6,245,247 | 6,315,914 |
| 7,169,316 | 6,526,658 | 7,210,767 | 11/056,146 | 11/635,523 | 6,665,094 | 6,450,605 |
| 6,512,596 | 6,654,144 | 7,125,090 | 6,687,022 | 7,072,076 | 7,092,125 | 7,215,443 |
| 7,136,195 | 7,077,494 | 6,877,834 | 6,969,139 | 10/636,227 | 7,283,280 | 6,912,067 |
| 7,277,205 | 7,154,637 | 10/636,230 | 7,070,251 | 6,851,782 | 10/636,211 | 10/636,247 |
| 6,843,545 | 7,079,286 | 7,064,867 | 7,065,247 | 7,027,177 | 7,218,415 | 7,064,873 |
| 6,954,276 | 7,061,644 | 7,092,127 | 7,059,695 | 10/990,382 | 7,177,052 | 7,270,394 |
| 11/124,231 | 7,188,921 | 7,187,469 | 7,196,820 | 11/281,445 | 11/329,041 | 7,251,051 |
| 7,245,399 | 11/524,911 | 11/640,267 | 11/706,297 | 11/730,387 | 11/737,142 | 11/764,729 |
| 11/834,637 | 11/853,019 | 11/863,239 | 11/305,274 | 11/305,273 | 11/305,275 | 11/305,152 |
| 11/305,158 | 11/305,008 | 6,231,148 | 6,293,658 | 6,614,560 | 6,238,033 | 6,312,070 |
| 6,238,111 | 6,378,970 | 6,196,739 | 6,270,182 | 6,152,619 | 7,006,143 | 6,876,394 |
| 6,738,096 | 6,970,186 | 6,287,028 | 6,412,993 | 11/033,145 | 11/102,845 | 11/102,861 |
| 11/248,421 | 11/672,878 | 7,204,941 | 7,282,164 | 10/815,628 | 11,845,672 | 7,278,727 |
| 10/913,373 | 10/913,374 | 10/913,372 | 7,138,391 | 7,153,956 | 10/913,380 | 10/913,379 |
| 10/913,376 | 7,122,076 | 7,148,345 | 11/172,816 | 11/172,815 | 11/172,814 | 11/482,990 |
| 11/482,986 | 11/482,985 | 11/454,899 | 11/583,942 | 11/592,990 | 11,849,360 | 11/831,961 |
| 11/831,962 | 11/831,963 | 6,095,700 | 11/832,629 | 11/832,637 | 60,971,535 | 10/407,212 |
| 7,252,366 | 10/683,064 | 10/683,041 | 7,275,811 | 10/884,889 | 10/922,890 | 10/922,875 |
| 10/922,885 | 10/922,889 | 10/922,884 | 10/922,879 | 10/922,887 | 10/922,888 | 10/922,874 |
| 7,234,795 | 10/922,871 | 10/922,880 | 10/922,881 | 10/922,882 | 10/922,883 | 10/922,878 |

-continued

| | | | | | | |
|---|---|---|---|---|---|---|
| 10/922,872 | 10/922,876 | 10/922,886 | 10/922,877 | 7,147,792 | 7,175,774 | 11/159,193 |
| 11/491,378 | 11,766,713 | 11/841,647 | 11/482,980 | 11/563,684 | 11/482,967 | 11/482,966 |
| 11/482,988 | 11/482,989 | 11/293,832 | 11/293,838 | 11/293,825 | 11/293,841 | 11/293,799 |
| 11/293,796 | 11/293,797 | 11/293,798 | 11/124,158 | 11/124,196 | 11/124,199 | 11/124,162 |
| 11/124,202 | 11/124,197 | 11/124,154 | 11/124,198 | 11/124,153 | 11/124,151 | 11/124,160 |
| 11/124,192 | 11/124,175 | 11/124,163 | 11/124,149 | 11/124,152 | 11/124,173 | 11/124,155 |
| 7,236,271 | 11/124,174 | 11/124,194 | 11/124,164 | 11/124,200 | 11/124,195 | 11/124,166 |
| 11/124,150 | 11/124,172 | 11/124,165 | 11/124,186 | 11/124,185 | 11/124,184 | 11/124,182 |
| 11/124,201 | 11/124,171 | 11/124,181 | 11/124,161 | 11/124,156 | 11/124,191 | 11/124,159 |
| 11/124,176 | 11/124,188 | 11/124,170 | 11/124,187 | 11/124,189 | 11/124,190 | 11/124,180 |
| 11/124,193 | 11/124,183 | 11/124,178 | 11/124,177 | 11/124,148 | 11/124,168 | 11/124,167 |
| 11/124,179 | 11/124,169 | 11/187,976 | 11/188,011 | 11/188,014 | 11/482,979 | 11/735,490 |
| 11/853,018 | 11/228,540 | 11/228,500 | 11/228,501 | 11/228,530 | 11/228,490 | 11/228,531 |
| 11/228,504 | 11/228,533 | 11/228,502 | 11/228,507 | 11/228,482 | 11/228,505 | 11/228,497 |
| 11/228,487 | 11/228,529 | 11/228,484 | 11/228,489 | 11/228,518 | 11/228,536 | 11/228,496 |
| 11/228,488 | 11/228,506 | 11/228,516 | 11/228,526 | 11/228,539 | 11/228,538 | 11/228,524 |
| 11/228,523 | 11/228,519 | 11/228,528 | 11/228,527 | 11/228,525 | 11/228,520 | 11/228,498 |
| 11/228,511 | 11/228,522 | 111/228,515 | 11/228,537 | 11/228,534 | 11/228,491 | 11/228,499 |
| 11/228,509 | 11/228,492 | 11/228,493 | 11/228,510 | 11/228,508 | 11/228,512 | 11/228,514 |
| 11/228,494 | 11/228,495 | 11/228,486 | 11/228,481 | 11/228,477 | 11/228,485 | 11/228,483 |
| 11/228,521 | 11/228,517 | 11/228,532 | 11/228,513 | 11/228,503 | 11/228,480 | 11/228,535 |
| 11/228,478 | 11/228,479 | 6,238,115 | 6,386,535 | 6,398,344 | 6,612,240 | 6,752,549 |
| 6,805,049 | 6,971,313 | 6,899,480 | 6,860,664 | 6,925,935 | 6,966,636 | 7,024,995 |
| 10/636,245 | 6,926,455 | 7,056,038 | 6,869,172 | 7,021,843 | 6,988,845 | 6,964,533 |
| 6,981,809 | 11/060,804 | 7,258,067 | 11/155,544 | 7,222,941 | 11/206,805 | 7,278,795 |
| 7,249,904 | 11/737,726 | 11,772,240 | 11/863,246 | 11/863,145 | 11/865,650 | 6,087,638 |
| 6,340,222 | 6,041,600 | 6,299,300 | 6,067,797 | 6,286,935 | 6,044,646 | 6,382,769 |
| 10/868,866 | 6,787,051 | 6,938,990 | 11/242,916 | 11/242,917 | 11/144,799 | 11/198,235 |
| 11,861,282 | 11,861,284 | 11/766,052 | 7,152,972 | 11/592,996 | D529,952 | 6,390,605 |
| 6,322,195 | 6,612,110 | 6,480,089 | 6,460,778 | 6,305,788 | 6,426,014 | 6,364,453 |
| 6,457,795 | 6,315,399 | 6,338,548 | 7,040,736 | 6,938,992 | 6,994,425 | 6,863,379 |
| 6,540,319 | 6,994,421 | 6,984,019 | 7,008,043 | 6,997,544 | 6,328,431 | 6,991,310 |
| 10/965,772 | 7,140,723 | 6,328,425 | 6,982,184 | 7,267,423 | 7,134,741 | 7,066,577 |
| 7,152,945 | 11/038,200 | 7,021,744 | 6,991,320 | 7,155,911 | 11/107,799 | 6,595,624 |
| 7,152,943 | 7,125,103 | 11/209,709 | 11/228,407 | 11/273,271 | 7,229,151 | 11/330,058 |
| 7,237,873 | 11/329,163 | 11/442,180 | 11/450,431 | 7,213,907 | 6,417,757 | 11/482,951 |
| 11/545,566 | 11/583,826 | 11/604,315 | 11/604,323 | 11/643,845 | 11/706,950 | 11/730,399 |
| 11,749,121 | 11/753,549 | 11/834,630 | | 7,095,309 | 6,854,825 | 6,623,106 |
| 6,672,707 | 6,575,561 | 6,817,700 | 6,588,885 | 7,075,677 | 6,428,139 | 6,575,549 |
| 6,846,692 | 6,425,971 | 7,063,993 | 6,383,833 | 6,955,414 | 6,412,908 | 6,746,105 |
| 6,953,236 | 6,412,904 | 7,128,388 | 6,398,343 | 6,652,071 | 6,793,323 | 6,659,590 |
| 6,676,245 | 7,201,460 | 6,464,332 | 6,659,593 | 6,478,406 | 6,978,613 | 6,439,693 |
| 6,502,306 | 6,966,111 | 6,863,369 | 6,428,142 | 6,874,868 | 6,390,591 | 6,799,828 |
| 6,896,358 | 7,018,016 | 10/296,534 | 6,328,417 | 6,322,194 | 6,382,779 | 6,629,745 |
| 6,565,193 | 6,609,786 | 6,609,787 | 6,439,908 | 6,684,503 | 6,843,551 | 6,764,166 |
| 6,561,617 | 10/510,092 | 6,557,970 | 6,546,628 | 10/510,098 | 6,652,074 | 6,820,968 |
| 7,175,260 | 6,682,174 | 10/510,207 | 6,648,453 | 6,834,932 | 6,682,176 | 6,998,062 |
| 6,767,077 | 7,278,717 | 6,755,509 | 10/534,813 | 6,692,108 | 10/534,811 | 6,672,709 |
| 10/534,823 | 7,086,718 | 10/534,881 | 6,672,710 | 10/534,812 | 6,669,334 | 10/534,804 |
| 7,152,958 | 10/534,817 | 6,824,246 | 7,264,336 | 6,669,333 | 10/534,815 | 6,820,967 |
| 10/534,883 | 6,736,489 | 7,264,335 | 6,719,406 | 7,222,943 | 7,188,419 | 7,168,166 |
| 6,974,209 | 7,086,719 | 6,974,210 | 7,195,338 | 7,252,775 | 7,101,025 | 11/474,281 |
| 11/485,258 | 11/706,304 | 11/706,324 | 11/706,326 | 11/706,321 | 11/772,239 | 11/782,598 |
| 11/829,941 | 11/852,991 | 11,852,986 | 11/763,440 | 11/763,442 | 11/246,687 | 11/246,718 |
| 11/246,685 | 11/246,686 | 11/246,703 | 11/246,691 | 11/246,711 | 11/246,690 | 11/246,712 |
| 11/246,717 | 11/246,709 | 11/246,700 | 11/246,701 | 11/246,702 | 11/246,668 | 11/246,697 |
| 11/246,698 | 11/246,699 | 11/246,675 | 11/246,674 | 11/246,667 | 11/829,957 | 11/829,960 |
| 11/829,961 | 11/829,962 | 11/829,963 | 11/829,966 | 11/829,967 | 11/829,968 | 11/829,969 |
| 7,156,508 | 7,159,972 | 7,083,271 | 7,165,834 | 7,080,894 | 7,201,469 | 7,090,336 |
| 7,156,489 | 10/760,233 | 10/760,246 | 7,083,257 | 7,258,422 | 7,255,423 | 7,219,980 |
| 10/760,253 | 10/760,255 | 10/760,209 | 7,118,192 | 10/760,194 | 10/760,238 | 7,077,505 |
| 7,198,354 | 7,077,504 | 10/760,189 | 7,198,355 | 10/760,232 | 10/760,231 | 7,152,959 |
| 7,213,906 | 7,178,901 | 7,222,938 | 7,108,353 | 7,104,629 | 11/446,227 | 11/454,904 |
| 11/472,345 | 11/474,273 | 7,261,401 | 11/474,279 | 11/482,939 | 11/482,950 | 11/499,709 |
| 11/592,984 | 11/601,668 | 11/603,824 | 11/601,756 | 11/601,672 | 11/650,546 | 11/653,253 |
| 11/706,328 | 11/706,299 | 11/706,965 | 11/737,080 | 11/737,041 | 11/778,062 | 11/778,566 |
| 11/782,593 | 11/246,684 | 11/246,672 | 11/246,673 | 11/246,683 | 11/246,682 | 60/939,086 |
| 11,860,538 | 11,860,539 | 11/860,540 | 11,860,541 | 11,860,542 | 7,246,886 | 7,128,400 |
| 7,108,355 | 6,991,322 | 10/728,790 | 7,118,197 | 10/728,784 | 10/728,783 | 7,077,493 |
| 6,962,402 | 10/728,803 | 7,147,308 | 10/728,779 | 7,118,198 | 7,168,790 | 7,172,270 |
| 7,229,155 | 6,830,318 | 7,195,342 | 7,175,261 | 10/773,183 | 7,108,356 | 7,118,202 |
| 10/773,186 | 7,134,744 | 10/773,185 | 7,134,743 | 7,182,439 | 7,210,768 | 10/773,187 |
| 7,134,745 | 7,156,484 | 7,118,201 | 7,111,926 | 10/773,184 | 7,018,021 | 11/060,751 |
| 11/060,805 | 11/188,017 | 7,128,402 | 11/298,774 | 11/329,157 | 11/490,041 | 11/501,767 |
| 11/499,736 | 7,246,885 | 7,229,156 | 11/505,846 | 11/505,857 | 11/505,856 | 11/524,908 |
| 11/524,938 | 7,258,427 | 11/524,912 | 7,278,716 | 11/592,995 | 11/603,825 | 11/649,773 |
| 11/650,549 | 11/653,237 | 11/706,378 | 11/706,962 | 11,749,118 | 11/754,937 | 11,749,120 |
| 11/744,885 | 11/779,850 | 11/765,439 | 11/842,950 | 11/839,539 | 11/097,308 | 11/097,309 |
| 7,246,876 | 11/097,299 | 11/097,310 | 11/097,213 | 11/210,687 | 11/097,212 | 7,147,306 |

-continued

| | | | | | | |
|---|---|---|---|---|---|---|
| 7,261,394 | 11/764,806 | 11/782,595 | 11/482,953 | 11/482,977 | 11/544,778 | 11/544,779 |
| 11/764,808 | 11/756,624 | 11/756,625 | 11/756,626 | 11/756,627 | 11/756,628 | 11/756,629 |
| 11/756,630 | 11/756,631 | 7,156,289 | 7,178,718 | 7,225,979 | 11/712,434 | 11/084,796 |
| 11/084,742 | 11/084,806 | 09/575,197 | 09/575,197 | 7,079,712 | 7,079,712 | 6,825,945 |
| 6,825,945 | 09/575,165 | 09/575,165 | 6,813,039 | 6,813,039 | 7,190,474 | 6,987,506 |
| 6,987,506 | 6,824,044 | 7,038,797 | 7,038,797 | 6,980,318 | 6,980,318 | 6,816,274 |
| 6,816,274 | 7,102,772 | 7,102,772 | 09/575,186 | 09/575,186 | 6,681,045 | 6,681,045 |
| 6,678,499 | 6,679,420 | 6,963,845 | 6,976,220 | 6,728,000 | 6,728,000 | 7,110,126 |
| 7,173,722 | 7,173,722 | 6,976,035 | 6,813,558 | 6,766,942 | 6,965,454 | 6,995,859 |
| 7,088,459 | 7,088,459 | 6,720,985 | 09/609,303 | 6,922,779 | 6,978,019 | 6,847,883 |
| 7,131,058 | 09/721,895 | 09/607,843 | 09/693,690 | 6,959,298 | 6,973,450 | 7,150,404 |
| 6,965,882 | 7,233,924 | 09/575,181 | 09/575,181 | 09/722,174 | 7,175,079 | 7,162,259 |
| 6,718,061 | 10/291,523 | 10/291,471 | 7,012,710 | 6,825,956 | 10/291,481 | 7,222,098 |
| 10/291,825 | 7,263,508 | 7,031,010 | 6,972,864 | 6,862,105 | 7,009,738 | 6,989,911 |
| 6,982,807 | 10/291,576 | 6,829,387 | 6,714,678 | 6,644,545 | 6,609,653 | 6,651,879 |
| 10/291,555 | 10/291,510 | 10/291,592 | 10/291,542 | 7,044,363 | 7,004,390 | 6,867,880 |
| 7,034,953 | 6,987,581 | 7,216,224 | 10/291,821 | 7,162,269 | 7,162,222 | 10/291,822 |
| 10/291,524 | 10/291,553 | 6,850,931 | 6,865,570 | 6,847,961 | 10/685,523 | 10/685,583 |
| 7,162,442 | 10/685,584 | 7,159,784 | 10/804,034 | 10/793,933 | 6,889,896 | 10/831,232 |
| 7,174,056 | 6,996,274 | 7,162,088 | 10/943,874 | 10/943,872 | 10/944,044 | 7,259,884 |
| 10/944,043 | 7,167,270 | 10/943,877 | 6,986,459 | 10/954,170 | 7,181,448 | 10/981,626 |
| 10/981,616 | 10/981,627 | 7,231,293 | 7,174,329 | 10/992,713 | 11/006,536 | 7,200,591 |
| 11/020,106 | 11/020,260 | 11/020,321 | 11/020,319 | 11/026,045 | 11/059,696 | 11/051,032 |
| 11/059,674 | 11/107,944 | 11/107,941 | 11/082,940 | 11/082,815 | 11/082,827 | 11/082,829 |
| 6,991,153 | 6,991,154 | 11/124,256 | 11/123,136 | 11/154,676 | 11/159,196 | 11/182,002 |
| 11/202,251 | 11/202,252 | 11/202,253 | 11/203,200 | 11/202,218 | 11/206,778 | 11/203,424 |
| 11/222,977 | 11/228,450 | 11/227,239 | 11/286,334 | 7,225,402 | 11/329,187 | 11/349,143 |
| 11/491,225 | 11/491,121 | 11/442,428 | 11/454,902 | 11/442,385 | 11/478,590 | 7,271,931 |
| 11/520,170 | 11/603,057 | 11/706,964 | 11/739,032 | 11,739,014 | 11/834,633 | 11/830,848 |
| 11/830,849 | 11/839,542 | 11/866,394 | 7,068,382 | 7,068,382 | 7,007,851 | 6,957,921 |
| 6,457,883 | 10/743,671 | 7,044,381 | 11/203,205 | 7,094,910 | 7,091,344 | 7,122,685 |
| 7,038,066 | 7,099,019 | 7,062,651 | 7,062,651 | 6,789,194 | 6,789,194 | 6,789,191 |
| 6,789,191 | 10/900,129 | 7,278,018 | 10/913,350 | 10/982,975 | 10/983,029 | 11/331,109 |
| 6,644,642 | 6,644,642 | 6,502,614 | 6,502,614 | 6,622,999 | 6,622,999 | 6,669,385 |
| 6,669,385 | 6,827,116 | 7,011,128 | 10/949,307 | 6,549,935 | 6,549,935 | 6,987,573 |
| 6,987,573 | 6,727,996 | 6,727,996 | 6,591,884 | 6,591,884 | 6,439,706 | 6,439,706 |
| 6,760,119 | 6,760,119 | 09/575,198 | 09/575,198 | 7,064,851 | 6,826,547 | 6,290,349 |
| 6,290,349 | 6,428,155 | 6,428,155 | 6,785,016 | 6,785,016 | 6,831,682 | 6,741,871 |
| 6,927,871 | 6,980,306 | 6,965,439 | 6,840,606 | 7,036,918 | 6,977,746 | 6,970,264 |
| 7,068,389 | 7,093,991 | 7,190,491 | 10/901,154 | 10/932,044 | 10/962,412 | 7,177,054 |
| 10/962,552 | 10/965,733 | 10/965,933 | 10/974,742 | 10/982,974 | 7,180,609 | 10/986,375 |
| 11/107,817 | 11/148,238 | 11/149,160 | 11/206,756 | 11/250,465 | 7,202,959 | 11/653,219 |
| 11/706,309 | 11/730,389 | 11/730,392 | 60/953,443 | 11/866,387 | 60,974,077 | 6,982,798 |
| 6,870,966 | 6,870,966 | 6,822,639 | 6,822,639 | 6,474,888 | 6,627,870 | 6,724,374 |
| 6,788,982 | 7,263,270 | 6,788,293 | 6,946,672 | 6,737,591 | 6,737,591 | 7,091,960 |
| 09/693,514 | 6,792,165 | 7,105,753 | 6,795,593 | 6,980,704 | 6,768,821 | 7,132,612 |
| 7,041,916 | 6,797,895 | 7,015,901 | 10/782,894 | 7,148,644 | 10/778,056 | 10/778,058 |
| 10/778,060 | 10/778,059 | 10/778,063 | 10/778,062 | 10/778,061 | 10/778,057 | 7,096,199 |
| 10/917,468 | 10/917,467 | 10/917,466 | 10/917,465 | 7,218,978 | 7,245,294 | 7,277,085 |
| 7,187,370 | 10/917,436 | 10/943,856 | 10/919,379 | 7,019,319 | 10/943,878 | 10/943,849 |
| 7,043,096 | 7,148,499 | 11/144,840 | 11/155,556 | 11/155,557 | 11/193,481 | 11/193,435 |
| 11/193,482 | 11/193,479 | 11/255,941 | 11/281,671 | 11/298,474 | 7,245,760 | 11/488,832 |
| 11/495,814 | 11/495,823 | 11/495,822 | 11/495,821 | 11/495,820 | 11/653,242 | 11/754,370 |
| 60,911,260 | 11/829,936 | 11/839,494 | 11,866,305 | 11,866,313 | 11,866,324 | 11,866,336 |
| 11,866,348 | 11,866,359 | 7,055,739 | 7,055,739 | 7,233,320 | 7,233,320 | 6,830,196 |
| 6,830,196 | 6,832,717 | 6,832,717 | 7,182,247 | 7,120,853 | 7,082,562 | 6,843,420 |
| 10/291,718 | 6,789,731 | 7,057,608 | 6,766,944 | 6,766,945 | 7,289,103 | 10/291,559 |
| 10/291,660 | 7,264,173 | 10/409,864 | 7,108,192 | 10/537,159 | 7,111,791 | 7,077,333 |
| 6,983,878 | 10/786,631 | 7,134,598 | 10/893,372 | 6,929,186 | 6,994,264 | 7,017,826 |
| 7,014,123 | 7,134,601 | 7,150,396 | 10/971,146 | 7,017,823 | 7,025,276 | 10/990,459 |
| 7,080,780 | 11/074,802 | 11/442,366 | 11,749,158 | 11/842,948 | 10/492,169 | 10/492,152 |
| 10/492,168 | 10/492,161 | 10/492,154 | 10/502,575 | 10/531,229 | 10/683,151 | 10/531,733 |
| 10/683,040 | 10/510,391 | 10/510,392 | 10/778,090 | 6,957,768 | 6,957,768 | 09/575,172 |
| 09/575,172 | 7,170,499 | 7,170,499 | 7,106,888 | 7,106,888 | 7,123,239 | 7,123,239 |
| 6,982,701 | 6,982,703 | 7,227527 | 6,786,397 | 6,947,027 | 6,975,299 | 7,139,431 |
| 7,048,178 | 7,118,025 | 6,839,053 | 7,015,900 | 7,010,147 | 7,133,557 | 6,914,593 |
| 10/291,546 | 6,938,826 | 7,278,566 | 7,123,245 | 6,992,662 | 7,190,346 | 11/074,800 |
| 11/074,782 | 11/074,777 | 11/075,917 | 7,221,781 | 11/102,843 | 7,213,756 | 11/188,016 |
| 7,180,507 | 7,263,225 | 11/442,114 | 11/737,094 | 11/753,570 | 11/782,596 | 11/865,711 |
| 11,856,061 | 11,856,062 | 11,856,064 | 11,856,066 | 11/672,522 | 11/672,950 | 11/672,947 |
| 11/672,891 | 11/672,954 | 11/672,533 | 11,754,310 | 11/754,321 | 11/754,320 | 11/754,319 |
| 11/754,318 | 11/754,317 | 11/754,316 | 11/754,315 | 11/754,314 | 11/754,313 | 11/754,312 |
| 11/754,311 | 6,593,166 | 7,132,679 | 6,940,088 | 7,119,357 | 11/513,077 | 6,755,513 |
| 6,974,204 | 6,409,323 | 7,055,930 | 6,281,912 | 6,893,109 | 6,604,810 | 6,824,242 |
| 6,318,920 | 7,210,867 | 6,488,422 | 6,655,786 | 6,457,810 | 6,485,135 | 6,796,731 |
| 6,904,678 | 6,641,253 | 7,125,106 | 6,786,658 | 7,097,273 | 6,824,245 | 7,222,947 |
| 6,918,649 | 6,860,581 | 6,929,351 | 7,063,404 | 6,969,150 | 7,004,652 | 6,871,938 |
| 6,905,194 | 6,846,059 | 6,997,626 | 10/974,881 | 7,029,098 | 6,966,625 | 7,114,794 |
| 7,207,646 | 7,077,496 | 11/071,117 | 11/072,529 | 7,152,938 | 7,182,434 | 7,182,430 |

-continued

| | | | | | | |
|---|---|---|---|---|---|---|
| 11/102,842 | 7,032,993 | 11/155,513 | 11/155,545 | 11/144,813 | 7,172,266 | 7,258,430 |
| 7,128,392 | 7,210,866 | 11/488,066 | 11/505,933 | 11/540,727 | 11/635,480 | 11/707,946 |
| 11/706,303 | 11/709,084 | 11/730,776 | 11/744,143 | 11/779,845 | 11/782,589 | 11/863,256 |
| 11/066,161 | 11/066,160 | 11/066,159 | 11/066,158 | 11/066,165 | 11/875,936 | 6,804,030 |
| 6,807,315 | 6,771,811 | 6,683,996 | 7,271,936 | 10/934,490 | 6,965,691 | 7,058,219 |
| 10/943,977 | 7,187,807 | 7,181,063 | 11/338,783 | 11/603,823 | 11/650,536 | 10/727,181 |
| 10/727,162 | 10/727,163 | 10/727,245 | 7,121,639 | 7,165,824 | 7,152,942 | 10/727,157 |
| 7,181,572 | 7,096,137 | 10/727,257 | 7,278,034 | 7,188,282 | 10/727,159 | 10/727,180 |
| 10/727,179 | 10/727,192 | 10/727,274 | 10/727,164 | 10/727,161 | 10/727,198 | 10/727,158 |
| 10/754,536 | 10/754,938 | 10/727,227 | 10/727,160 | 10/934,720 | 7,171,323 | 7,278,697 |
| 11/442,131 | 11/474,278 | 11/488,853 | 11/488,841 | 11,749,750 | 11,749,749 | 10/296,522 |
| 6,795,215 | 7,070,098 | 7,154,638 | 6,805,419 | 6,859,289 | 6,977,751 | 6,398,332 |
| 6,394,573 | 6,622,923 | 6,747,760 | 6,921,144 | 10/884,881 | 7,092,112 | 7,192,106 |
| 11/039,866 | 7,173,739 | 6,986,560 | 7,008,033 | 11/148,237 | 7,222,780 | 7,270,391 |
| 7,150,510 | 11/478,599 | 11/499,749 | 11/521,388 | 11/738,518 | 11/482,981 | 11/743,662 |
| 11/743,661 | 11/743,659 | 11/743,655 | 11/743,657 | 11/752,900 | 7,195,328 | 7,182,422 |
| 11/650,537 | 11/712,540 | 10/854,521 | 10/854,522 | 10/854,488 | 7,281,330 | 10/854,503 |
| 10/854,504 | 10/854,509 | 7,188,928 | 7,093,989 | 10/854,497 | 10/854,495 | 10/854,498 |
| 10/854,511 | 10/854,512 | 10/854,525 | 10/854,526 | 10/854,516 | 10/854,508 | 7,252,353 |
| 10/854,515 | 7,267,417 | 10/854,505 | 10/854,493 | 7,275,805 | 10/854,489 | 10/854,490 |
| 7,281,777 | 10/854,491 | 10/854,528 | 10/854,523 | 10/854,527 | 10/854,524 | 10/854,520 |
| 10/854,514 | 10/854,519 | 10/854,513 | 10/854,499 | 10/854,501 | 7,266,661 | 7,243,193 |
| 10/854,518 | 10/854,517 | 10/934,628 | 7,163,345 | 11/499,803 | 11/601,757 | 11/706,295 |
| 11/735,881 | 11,748,483 | 11,749,123 | 11/766,061 | 11,775,135 | 11,772,235 | 11/778,569 |
| 11/829,942 | 11/870,342 | 11/014,731 | D529,081 | D541,848 | D528,597 | 6,924,907 |
| 6,712,452 | 6,416,160 | 6,238,043 | 6,958,826 | 6,812,972 | 6,553,459 | 6,967,741 |
| 6,956,669 | 6,903,766 | 6,804,026 | 7,259,889 | 6,975,429 | 10/636,234 | 10/636,233 |
| 10/636,217 | 10/636,216 | 7,274,485 | 7,139,084 | 7,173,735 | 7,068,394 | 10/636,276 |
| 7,086,644 | 7,250,977 | 7,146,281 | 7,023,567 | 7,136,183 | 7,083,254 | 6,796,651 |
| 7,061,643 | 7,057,758 | 6,894,810 | 6,995,871 | 7,085,010 | 7,092,126 | 7,123,382 |
| 7,061,650 | 10/853,143 | 6,986,573 | 6,974,212 | 10/943,907 | 7,173,737 | 10/954,168 |
| 7,246,868 | 11/065,357 | 7,137,699 | 11/107,798 | 7,148,994 | 7,077,497 | 11/176,372 |
| 7,248,376 | 11/225,158 | 11/225,154 | 7,173,729 | 11/442,132 | 11/478,607 | 11/503,085 |
| 11/545,502 | 11/583,943 | 11/585,946 | 11/653,239 | 11/653,238 | 11/764,781 | 11/764,782 |
| 11/779,884 | 11,845,666 | 11/872,637 | 11/544,764 | 11/544,765 | 11/544,772 | 11/544,773 |
| 11/544,774 | 11/544,775 | 11/544,776 | 11/544,766 | 11/544,767 | 11/544,771 | 11/544,770 |
| 11/544,769 | 11/544,777 | 11/544,768 | 11/544,763 | 11/293,804 | 11/293,840 | 11/293,803 |
| 11/293,833 | 11/293,834 | 11/293,835 | 11/293,836 | 11/293,837 | 11/293,792 | 11/293,794 |
| 11/293,839 | 11/293,826 | 11/293,829 | 11/293,830 | 11/293,827 | 11/293,828 | 7,270494 |
| 11/293,823 | 11/293,824 | 11/293,831 | 11/293,815 | 11/293,819 | 11/293,818 | 11/293,817 |
| 11/293,816 | 11/838,875 | 11/482,978 | 11/640,356 | 11/640,357 | 11/640,358 | 11/640,359 |
| 11/640,360 | 11/640,355 | 11/679,786 | 11/872,714 | 10/760,254 | 10/760,210 | 10/760,202 |
| 7,201,468 | 10/760,198 | 10/760,249 | 7,234,802 | 10/760,196 | 10/760,247 | 7,156,511 |
| 10/760,264 | 7,258,432 | 7,097,291 | 10/760,222 | 10/760,248 | 7,083,273 | 10/760,192 |
| 10/760,203 | 10/760,204 | 10/760,205 | 10/760,206 | 10/760,267 | 10/760,270 | 7,198,352 |
| 10/760,271 | 10/760,275 | 7,201,470 | 7,121,655 | 10/760,184 | 7,232,208 | 10/760,186 |
| 10/760,261 | 7,083,272 | 7,261,400 | 11/474,272 | 11/474,315 | 11/501,771 | 11/583,874 |
| 11/650,554 | 11/706,322 | 11/706,968 | 11/749,119 | 11749,157 | 11,779,848 | 11/782,590 |
| 11/855,152 | 11,855,151 | 11,870,327 | 11/014,764 | 11/014,763 | 11/014,748 | 11/014,747 |
| 11/014,761 | 11/014,760 | 11/014,757 | 11/014,714 | 7,249,822 | 11/014,762 | 11/014,724 |
| 11/014,723 | 11/014,756 | 11/014,736 | 11/014,759 | 11/014,758 | 11/014,725 | 11/014,739 |
| 11/014,738 | 11/014,737 | 11/014,726 | 11/014,745 | 11/014,712 | 7,270,405 | 11/014,751 |
| 11/014,735 | 11/014,734 | 11/014,719 | 11/014,750 | 11/014,749 | 7,249,833 | 11/758,640 |
| 11/775,143 | 11/838,877 | 11/014,769 | 11/014,729 | 11/014,743 | 11/014,733 | 11/014,754 |
| 11/014,755 | 11/014,765 | 11/014,766 | 11/014,740 | 11/014,720 | 11/014,753 | 7,255,430 |
| 11/014,744 | 11/014,741 | 11/014,768 | 11/014,767 | 11/014,718 | 11/014,717 | 11/014,716 |
| 11/014,732 | 11/014,742 | 11/097,268 | 11/097,185 | 11/097,184 | 11/778,567 | 11,852,958 |
| 11,852,907 | 11/872,038 | 11/293,820 | 11/293,813 | 11/293,822 | 11/293,812 | 11/293,821 |
| 11/293,814 | 11/293,793 | 11/293,842 | 11/293,811 | 11/293,807 | 11/293,806 | 11/293,805 |
| 11/293,810 | 11/688,863 | 11/688,864 | 11/688,865 | 11/688,866 | 11/688,867 | 11/688,868 |
| 11/688,869 | 11/688,871 | 11/688,872 | 11/688,873 | 11/741,766 | 11/482,982 | 11/482,983 |
| 11/482,984 | 11/495,818 | 11/495,819 | 11/677,049 | 11/677,050 | 11/677,051 | 11,872,719 |
| 11,872,718 | 11/014,722 | D528,156 | 10/760,180 | 7,111,935 | 10/760,213 | 10/760,219 |
| 10/760,237 | 7,261,482 | 10/760,220 | 7,002,664 | 10/760,252 | 10/760,265 | 7,088,420 |
| 11/446,233 | 11/503,083 | 11/503,081 | 11/516,487 | 11/599,312 | 6,364,451 | 6,533,390 |
| 6,454,378 | 7,224,478 | 6,559,969 | 6,896,362 | 7,057,760 | 6,982,799 | 11/202,107 |
| 11/743,672 | 11,744,126 | 11/743,673 | 7,093,494 | 7,143,652 | 7,089,797 | 7,159,467 |
| 7,234,357 | 7,124,643 | 7,121,145 | 7,089,790 | 7,194,901 | 6,968,744 | 7,089,798 |
| 7,240,560 | 7,137,302 | 11/442,177 | 7,171,855 | 7,260,995 | 7,260,993 | 7,165,460 |
| 7,222,538 | 7,258,019 | 11/543,047 | 7,258,020 | 11/604,324 | 11/642,520 | 11/706,305 |
| 11/707,056 | 11,744,211 | 11/767,526 | 11/779,846 | 11/764,227 | 11/829,943 | 11/829,944 |
| 6,454,482 | 6,808,330 | 6,527,365 | 6,474,773 | 6,550,997 | 7,093,923 | 6,957,923 |
| 7,131,724 | 10/949,288 | 7,168,867 | 7,125,098 | 11/706,966 | 11/185,722 | 7,249,901 |
| 7,188,930 | 11/014,728 | 11/014,727 | D536,031 | D531,214 | 7,237,888 | 7,168,654 |
| 7,201,272 | 6,991,098 | 7,217,051 | 6,944,970 | 10/760,215 | 7,108,434 | 10/760,257 |
| 7,210,407 | 7,186,042 | 10/760,266 | 6,920,704 | 7,217,049 | 10/760,214 | 10/760,260 |
| 7,147,102 | 10/760,269 | 7,249,838 | 10/760,241 | 10/962,413 | 10/962,427 | 7,261,477 |
| 7,225,739 | 10/962,402 | 10/962,425 | 10/962,428 | 7,191,978 | 10/962,426 | 10/962,409 |
| 10/962,417 | 10/962,403 | 7,163,287 | 7,258,415 | 10/962,523 | 7,258,424 | 10/962,410 |

-continued

| | | | | | | |
|---|---|---|---|---|---|---|
| 7,195,412 | 7,207,670 | 7,270,401 | 7,220,072 | 11/474,267 | 11/544,547 | 11/585,925 |
| 11/593,000 | 11/706,298 | 11/706,296 | 11/706,327 | 11/730,760 | 11/730,407 | 11/730,787 |
| 11/735,977 | 11/736,527 | 11/753,566 | 11/754,359 | 11/778,061 | 11/765,398 | 11/778,556 |
| 11/829,937 | 11/780,470 | 11/866,399 | 11/223,262 | 11/223,018 | 11/223,114 | 11/223,022 |
| 11/223,021 | 11/223,020 | 11/223,019 | 11/014,730 | D541,849 | 29/279,123 | 6,716,666 |
| 6,949,217 | 6,750,083 | 7,014,451 | 6,777,259 | 6,923,524 | 6,557,978 | 6,991,207 |
| 6,766,998 | 6,967,354 | 6,759,723 | 6,870,259 | 10/853,270 | 6,925,875 | 10/898,214 |
| 7,095,109 | 7,145,696 | 10/976,081 | 7,193,482 | 7,134,739 | 7,222,939 | 7,164,501 |
| 7,118,186 | 7,201,523 | 7,226,159 | 7,249,839 | 7,108,343 | 7,154,626 | 7,079,292 |
| 10/980,184 | 7,233,421 | 7,063,408 | 10/983,082 | 10/982,804 | 7,032,996 | 10/982,834 |
| 10/982,833 | 10/982,817 | 7,217,046 | 6,948,870 | 7,195,336 | 7,070,257 | 10/986,813 |
| 10/986,785 | 7,093,922 | 6,988,789 | 10/986,788 | 7,246,871 | 10/992,748 | 10/992,747 |
| 7,187,468 | 10/992,828 | 7,196,814 | 10/992,754 | 7,268,911 | 7,265,869 | 7,128,384 |
| 7,164,505 | 11/003,595 | 7,025,434 | 11/003,481 | 7,280,244 | 7,206,098 | 7,265,877 |
| 7,193,743 | 7,168,777 | 11/006,734 | 7,195,329 | 7,198,346 | 7,281,786 | 11/013,363 |
| 11/013,881 | 6,959,983 | 7,128,386 | 7,097,104 | 11/013,636 | 7,083,261 | 7,070,258 |
| 7,083,275 | 7,110,139 | 6,994,419 | 6,935,725 | 11/026,046 | 7,178,892 | 7,219,429 |
| 6,988,784 | 11/026,135 | 7,289,156 | 11/064,005 | 11/064,006 | 7,178,903 | 7,273,274 |
| 7,083,256 | 11/064,008 | 7,278,707 | 11/064,013 | 6,974,206 | 11/064,004 | 7,066,588 |
| 7,222,940 | 11/075,918 | 7,018,025 | 7,221,867 | 11/072,517 | 7,188,938 | 7,021,742 |
| 7,083,262 | 7,192,119 | 11/083,021 | 7,036,912 | 7,175,256 | 7,182,441 | 7,083,258 |
| 7,114,796 | 7,147,302 | 11/084,757 | 7,219,982 | 7,118,195 | 7,229,153 | 6,991,318 |
| 7,108,346 | 11/248,429 | 11/239,031 | 7,178,899 | 7,066,579 | 11/281,419 | 11/298,633 |
| 11/329,188 | 11/329,140 | 7,270,397 | 7,258,425 | 7,237,874 | 7,152,961 | 11/478,592 |
| 7,207,658 | 11/484,744 | 11/488,867 | 7,207,659 | 11/525,857 | 11/540,569 | 11/583,869 |
| 11/592,985 | 11/585,947 | 11/601,762 | 11/604,316 | 11/604,309 | 11/604,303 | 11/643,844 |
| 11/650,553 | 11/655,940 | 11/653,320 | 7,278,713 | 11/706,381 | 11/706,323 | 11/706,963 |
| 11/713,660 | 11/730,408 | 11/696,186 | 11/730,390 | 11/737,139 | 11/737,749 | 11/740,273 |
| 11,749,122 | 11/754,361 | 11,766,043 | 11/764,775 | 11/768,872 | 11/775,156 | 11/779,271 |
| 11/779,272 | 11/829,938 | 11/839,502 | 11,858,852 | 11/862,188 | 019863/0806 | 11/872,618 |
| 6,485,123 | 6,425,657 | 6,488,358 | 7,021,746 | 6,712,986 | 6,981,757 | 6,505,912 |
| 6,439,694 | 6,364,461 | 6,378,990 | 6,425,658 | 6,488,361 | 6,814,429 | 6,471,336 |
| 6,457,813 | 6,540,331 | 6,454,396 | 6,464,325 | 6,443,559 | 6,435,664 | 6,412,914 |
| 6,488,360 | 6,550,896 | 6,439,695 | 6,447,100 | 09/900,160 | 6,488,359 | 6,637,873 |
| 10/485,738 | 6,618,117 | 10/485,737 | 6,803,989 | 7,234,801 | 7,044,589 | 7,163,273 |
| 6,416,154 | 6,547,364 | 10/485,744 | 6,644,771 | 7,152,939 | 6,565,181 | 10/485,805 |
| 6,857,719 | 7,255,414 | 6,702,417 | 10/485,652 | 6,918,654 | 7,070,265 | 6,616,271 |
| 6,652,078 | 6,503,408 | 6,607,263 | 7,111,924 | 6,623,108 | 6,698,867 | 6,488,362 |
| 6,625,874 | 6,921,153 | 7,198,356 | 6,536,874 | 6,425,651 | 6,435,667 | 10/509,997 |
| 6,527,374 | 10/510,154 | 6,582,059 | 10/510,152 | 6,513,908 | 7,246,883 | 6,540,332 |
| 6,547,368 | 7,070,256 | 6,508,546 | 10/510,151 | 6,679,584 | 10/510,000 | 6,857,724 |
| 10/509,998 | 6,652,052 | 10/509,999 | 6,672,706 | 10/510,096 | 6,688,719 | 6,712,924 |
| 6,588,886 | 7,077,508 | 7,207,654 | 6,935,724 | 6,927,786 | 6,988,787 | 6,899,415 |
| 6,672,708 | 6,644,767 | 6,874,866 | 6,830,316 | 6,994,420 | 6,954,254 | 7,086,720 |
| 7,240,992 | 7,267,424 | 7,128,397 | 7,084,951 | 7,156,496 | 7,066,578 | 7,101,023 |
| 11/165,027 | 11/202,235 | 11/225,157 | 7,159,965 | 7,255,424 | 11/349,519 | 7,137,686 |
| 7,201,472 | 11/442,413 | 11/504,602 | 7,216,957 | 11/520,572 | 11/583,858 | 11/583,895 |
| 11/585,976 | 11/635,488 | 7,278,712 | 11/706,952 | 11/706,307 | 11/785,109 | 11/740,287 |
| 11/754,367 | 11/758,643 | 11/778,572 | 11,859,791 | 11/863,260 | 11/874,178 | 6,916,082 |
| 6,786,570 | 10/753,478 | 6,848,780 | 6,966,633 | 7,179,395 | 6,969,153 | 6,979,075 |
| 7,132,056 | 6,832,828 | 6,860,590 | 6,905,620 | 6,786,574 | 6,824,252 | 7,097,282 |
| 6,997,545 | 6,971,734 | 6,918,652 | 6,978,990 | 6,863,105 | 10/780,624 | 7,194,629 |
| 10/791,792 | 6,890,059 | 6,988,785 | 6,830,315 | 7,246,881 | 7,125,102 | 7,028,474 |
| 7,066,575 | 6,986,202 | 7,044,584 | 7,210,762 | 7,032,992 | 7,140,720 | 7,207,656 |
| 11/031,084 | 11/048,748 | 7,008,041 | 7,011,390 | 7,048,868 | 7,014,785 | 7,131,717 |
| 11/148,236 | 11/176,158 | 7,182,436 | 7,104,631 | 7,240,993 | 11/206,920 | 11/202,217 |
| 7,172,265 | 11/231,876 | 7,066,573 | 11/298,635 | 7,152,949 | 11/442,161 | 11/442,133 |
| 11/442,126 | 7,156,492 | 11/478,588 | 11/505,848 | 11/520,569 | 11/525,861 | 11/583,939 |
| 11/545,504 | 11/583,894 | 11/635,485 | 11/730,391 | 11/730,788 | 11/749,148 | 11/749,149 |
| 11/749,152 | 11/749,151 | 11/759,886 | 11/865,668 | 11/874,168 | 11/874,203 | 6,824,257 |
| 7,270,475 | 6,971,811 | 6,878,564 | 6,921,145 | 6,890,052 | 7,021,747 | 6,929,345 |
| 6,811,242 | 6,916,087 | 6,905,195 | 6,899,416 | 6,883,906 | 6,955,428 | 10/882,775 |
| 6,932,459 | 6,962,410 | 7,033,008 | 6,962,409 | 7,013,641 | 7,204,580 | 7,032,997 |
| 6,998,278 | 7,004,563 | 6,910,755 | 6,969,142 | 6,938,994 | 7,188,935 | 10/959,049 |
| 7,134,740 | 6,997,537 | 7,004,567 | 6,916,091 | 7,077,588 | 6,918,707 | 6,923,583 |
| 6,953,295 | 6,921,221 | 7,001,008 | 7,168,167 | 7,210,759 | 11/008,115 | 11/011,120 |
| 11/012,329 | 6,988,790 | 7,192,120 | 7,168,789 | 7,004,577 | 7,052,120 | 11/123,007 |
| 6,994,426 | 7,258,418 | 7,014,298 | 11/124,348 | 11/177,394 | 7,152,955 | 7,097,292 |
| 7,207,657 | 7,152,944 | 7,147,303 | 11/209,712 | 7,134,608 | 7,264,333 | 7,093,921 |
| 7,077,590 | 7,147,297 | 11/239,029 | 11/248,832 | 11/248,428 | 11/248,434 | 7,077,507 |
| 7,172,672 | 7,175,776 | 7,086,717 | 7,101,020 | 11/329,155 | 7,201,466 | 11/330,057 |
| 7,152,967 | 7,182,431 | 7,210,666 | 7,252,367 | 11/450,586 | 11/485,255 | 11/525,860 |
| 6,945,630 | 7,018,294 | 6,910,014 | 6,659,447 | 6,648,321 | 7,082,980 | 6,672,584 |
| 7,073,551 | 6,830,395 | 7,289,727 | 7,001,011 | 6,880,922 | 6,886,915 | 6,644,787 |
| 6,641,255 | 7,066,580 | 6,652,082 | 10/309,036 | 6,666,544 | 6,666,543 | 6,669,332 |
| 6,984,023 | 6,733,104 | 6,644,793 | 6,723,575 | 6,953,235 | 6,663,225 | 7,076,872 |
| 7,059,706 | 7,185,971 | 7,090,335 | 6,854,827 | 6,793,974 | 10/636,258 | 7,222,929 |
| 6,739,701 | 7,073,881 | 7,155,823 | 7,219,427 | 7,008,503 | 6,783,216 | 6,883,890 |
| 6,857,726 | 10/636,274 | 6,641,256 | 6,808,253 | 6,827,428 | 6,802,587 | 6,997,534 |

-continued

| | | | | | | |
|---|---|---|---|---|---|---|
| 6,959,982 | 6,959,981 | 6,886,917 | 6,969,473 | 6,827,425 | 7,007,859 | 6,802,594 |
| 6,792,754 | 6,860,107 | 6,786,043 | 6,863,378 | 7,052,114 | 7,001,007 | 10/729,151 |
| 10/729,157 | 6,948,794 | 6,805,435 | 6,733,116 | 10/683,006 | 7,008,046 | 6,880,918 |
| 7,066,574 | 6,983,595 | 6,923,527 | 7,275,800 | 7,163,276 | 7,156,495 | 6,976,751 |
| 6,994,430 | 7,014,296 | 7,059,704 | 7,160,743 | 7,175,775 | 11/058,238 | 7,097,283 |
| 7,140,722 | 11/123,009 | 11/123,008 | 7,080,893 | 7,093,920 | 7,270,492 | 7,128,093 |
| 7,052,113 | 7,055,934 | 11/155,627 | 7,278,796 | 11/159,197 | 7,083,263 | 7,145,592 |
| 7,025,436 | 11/281,444 | 7,258,421 | 11/478,591 | 11/478,735 | 7,226,147 | 11/482,940 |
| 7,195,339 | 11/503,061 | 11/505,938 | 11/520,577 | 11/525,863 | 11/544,577 | 11/540,576 |
| 11/585,964 | 11/592,991 | 11/599,342 | 11/600,803 | 11/604,321 | 11/604,302 | 11/635,535 |
| 11/635,486 | 11/643,842 | 11/655,987 | 11/650,541 | 11/706,301 | 11/707,039 | 11/730,388 |
| 11/730,786 | 11/730,785 | 11/739,080 | 11/764,746 | 11/768,875 | 11/779,847 | 11/829,940 |
| 11,847,240 | 11/834,625 | 11/863,210 | 11/865,680 | 11/874,156 | 7,067,067 | 6,776,476 |
| 6,880,914 | 7,086,709 | 6,783,217 | 7,147,791 | 6,929,352 | 7,144,095 | 6,820,974 |
| 6,918,647 | 6,984,016 | 7,192,125 | 6,824,251 | 6,834,939 | 6,840,600 | 6,786,573 |
| 7,144,519 | 6,799,835 | 6,959,975 | 6,959,974 | 7,021,740 | 6,935,718 | 6,938,983 |
| 6,938,991 | 7,226,145 | 7,140,719 | 6,988,788 | 7,022,250 | 6,929,350 | 7,011,393 |
| 7,004,566 | 7,175,097 | 6,948,799 | 7,143,944 | 10/965,737 | 7,029,100 | 6,957,811 |
| 7,073,724 | 7,055,933 | 7,077,490 | 7,055,940 | 10/991,402 | 7,234,645 | 7,032,999 |
| 7,066,576 | 7,229,150 | 7,086,728 | 7,246,879 | 11/144,809 | 7,140,718 | 11/144,802 |
| 7,144,098 | 7,044,577 | 11/144,808 | 11/172,896 | 7,189,334 | 7,055,935 | 7,152,860 |
| 11/203,188 | 11/203,173 | 11/202,343 | 7,213,989 | 11/225,156 | 11/225,173 | 11/228,433 |
| 7,114,868 | 7,168,796 | 7,159,967 | 11/272,425 | 7,152,805 | 11/298,530 | 11/330,061 |
| 7,133,799 | 11/330,054 | 11/329,284 | 7,152,956 | 7,128,399 | 7,147,305 | 11/446,241 |
| 11/442,160 | 7,246,884 | 7,152,960 | 11/442,125 | 11/454,901 | 11/442,134 | 11/450,441 |
| 11/474,274 | 11/499,741 | 7,270,399 | 6,857,728 | 6,857,729 | 6,857,730 | 6,989,292 |
| 6,977,189 | 6,982,189 | 7,173,332 | 7,026,176 | 6,979,599 | 6,812,062 | 6,886,751 |
| 10/804,057 | 10/804,036 | 7,001,793 | 6,866,369 | 6,946,743 | 10/804,048 | 6,886,918 |
| 7059720 | 10/846,561 | 10/846,562 | 10/846,647 | 10/846,649 | 10/846,627 | 6,951,390 |
| 6,981,765 | 6,789,881 | 6,802,592 | 7,029,097 | 6,799,836 | 7,048,352 | 7,182,267 |
| 7,025,279 | 6,857,571 | 6,817,539 | 6,830,198 | 6,992,791 | 7,038,809 | 6,980,323 |
| 7,148,992 | 7,139,091 | 6,947,173 | 7,101,034 | 6,969,144 | 6,942,319 | 6,827,427 |
| 6,984,021 | 6,984,022 | 6,869,167 | 6,918,542 | 7,007,852 | 6,899,420 | 6,918,665 |
| 6,997,625 | 6,988,840 | 6,984,080 | 6,845,978 | 6,848,687 | 6,840,512 | 6,863,365 |
| 7,204,582 | 6,921,150 | 7,128,396 | 6,913,347 | 7,008,819 | 6,935,736 | 6,991,317 |
| 11/033,122 | 7,055,947 | 7,093,928 | 7,100,834 | 7,270,396 | 7,187,086 | 11/072,518 |
| 7,032,825 | 7,086,721 | 11/171,428 | 7,159,968 | 7,010,456 | 7,147,307 | 7,111,925 |
| 11/144,812 | 7,229,154 | 11/505,849 | 11/520,570 | 11/520,575 | 11/546,437 | 11/540,575 |
| 11/583,937 | 7,278,711 | 11/592,211 | 11/592,207 | 11/635,489 | 11/604,319 | 11/635,490 |
| 11/635,525 | 11/650,540 | 11/706,366 | 11/706,310 | 11/706,308 | 11/785,108 | 11/744,214 |
| 11,744,218 | 11,748,485 | 11,748,490 | 11/764,778 | 11/766,025 | 11/834,635 | 11,839,541 |
| 11,860,420 | 11/865,693 | 11/863,118 | 11/866,307 | 11/866,340 | 11/869,684 | 11/869,722 |
| 11/869,694 | 11/876,592 | | | | | |

The disclosures of these applications and patents are incorporated herein by reference.

FIELD OF THE INVENTION

The present invention relates to the field of inkjet printheads manufactured using micro-electromechanical systems (MEMS) techniques.

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 (Sweet et al) also discloses a process of a continuous ink jet printing including the step wherein the ink jet stream is modulated by a high frequency electro-static field so as to cause drop separation. This technique is still utilized by several manufacturers including Elmjet and Scitex (see also U.S. Pat. No. 3,373,437 (Sweet et al)

Piezoelectric ink jet printers are also one form of commonly utilized ink jet printing device. Piezoelectric systems are disclosed by Kyser et. al. in U.S. Pat. No. 3,946,398 which utilizes a diaphragm mode of operation, by Zolten in U.S. Pat. No. 3,683,212 which discloses a squeeze mode of operation of a piezoelectric crystal, Stemme in U.S. Pat. No. 3,747,120 discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

More recently, thermal ink jet printing has become an extremely popular form of ink jet printing. The ink jet printing techniques include those disclosed by Endo et al in GB 2007162 and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Many inkjet printheads are constructed utilizing microelectromechanical systems (MEMS) techniques. As such, they tend to rely upon standard integrated circuit construction/fabrication techniques of depositing planar layers on a silicon wafer and etching certain portions of the planar layers. Within silicon circuit fabrication technology, certain techniques are better known than others. For example, the techniques associated with the creation of CMOS circuits are likely to be more readily used than those associated with the creation of exotic circuits including ferroelectrics, gallium arsenide etc. Hence, it is desirable, in any MEMS constructions, to utilize well proven semi-conductor fabrication techniques which do not require any "exotic" processes or materials. Of course, a certain degree of trade off will be undertaken in that if the advantages of using the exotic material far out weighs its disadvantages then it may become desirable to utilize the material anyway. However, if it is possible to achieve the same, or similar, properties using more common materials, the problems of exotic materials can be avoided.

An important aspect of any inkjet printer is printhead maintenance. Printhead maintenance increases the lifetime of a printhead and enables the printhead to be used after idle periods. Typical aims of printhead maintenance are the removal of particulates from the printhead, removing ink flooded onto the printhead face, and unblocking of nozzles which may become blocked with ink ('decap') or particulates. Hitherto, a variety of techniques have been used for printhead maintenance, such as suction cappers and squeegee-type wipers.

However, the usual problems of printhead maintenance are exacerbated in the Applicant's pagewidth printheads, which have high-density nozzles constructed on a silicon wafer using MEMS techniques. Whilst these printheads are very inexpensive to manufacture, they are typically less robust than other inkjet printheads and, hence, have hitherto required special consideration of printhead maintenance. Accordingly, the Applicant has proposed a number of novel techniques for printhead maintenance, including non-contact maintenance techniques. Some of these maintenance techniques are exemplified in the Applicant's commonly assigned U.S. application Ser. No. 11/246,688 (filed Oct. 11, 2005); Ser. No. 11/246,707 (filed Oct. 11, 2005); Ser. No. 11/246,693 (filed Oct. 11, 2005); Ser. No. 11/482,958 (filed Jul. 10, 2006); and Ser. No. 11/495,815 (filed Jul. 31, 2006), the contents of each of which are herein incorporated by reference.

It would be desirable to provide a MEMS pagewidth printhead, which is amenable to a plethora of printhead maintenance techniques, including contact maintenance techniques. It would be further desirable to provide a MEMS printhead having superior mechanical robustness. It would be further desirable to provide a MEMS printhead, which traps a minimal number of particulates and hence facilitates printhead maintenance.

SUMMARY OF THE INVENTION

In a first aspect, there is provided an inkjet printhead comprising a reinforced bi-layered nozzle plate structure spanning across a plurality of nozzles.

Optionally, each nozzle comprises a nozzle chamber having a roof, each roof being defined by part of said nozzle plate structure.

Optionally, the nozzle chambers are formed on a substrate.

Optionally, each nozzle chamber comprises said roof spaced apart from said substrate, and sidewalls extending between said roof and said substrate.

Optionally, each roof has a nozzle aperture defined therein.

Optionally, the nozzle plate structure comprises:

a first nozzle plate spanning a plurality of nozzles, said first nozzle plate having a plurality of cavities defined therein;

photoresist filling said cavities; and a second nozzle plate covering said first nozzle plate and said photoresist.

Optionally, the second nozzle plate defines a planar, exterior surface of said printhead.

Optionally, the first and second nozzle plates are comprised of the same or different materials.

Optionally, the materials are ceramic materials depositable by PECVD.

Optionally, the materials are independently selected from the group comprising: silicon nitride, silicon oxide and silicon oxynitride.

Optionally, each nozzle comprises a nozzle chamber formed on a substrate, said nozzle chamber comprising a roof spaced apart from said substrate and sidewalls extending between said roof and said substrate, wherein said first nozzle plate and said sidewalls are comprised of the same material.

In a second aspect, there is provided an inkjet printhead integrated circuit comprising:

a substrate having a plurality of nozzles formed thereon;

drive circuitry electrically connected to actuators associated with said nozzles; and a reinforced bi-layered nozzle plate structure spanning across said plurality of nozzles.

In a third aspect, there is provided a method of fabricating an inkjet printhead having a planar nozzle plate, the method comprising the steps of:

(a) providing a partially-fabricated printhead having a first nozzle plate comprised of a first material spanning a plurality of nozzles, said first nozzle plate having a plurality of cavities;

(b) filling said cavities with a filler, such that an upper surface of said first nozzle plate and an upper surface of said filler together define a contiguous planar surface; and (c) depositing a second material onto said planar surface to form a second nozzle plate having a planar exterior surface.

Optionally, the second material is deposited by PECVD.

Optionally, the first material is deposited by PECVD onto a non-planar sacrificial scaffold to form said first nozzle plate.

Optionally, the first and second materials are the same or different from each other.

Optionally, the first and second materials are independently selected from the group comprising: silicon nitride, silicon oxide and silicon oxynitride.

Optionally, the filler is photoresist.

Optionally, step (b) is performed by the sub-steps of:

(b)(i) depositing a layer of photoresist onto said first nozzle plate so as to fill said cavities; and (b)(ii) removing a portion of said photoresist such that an upper surface of said first nozzle plate and an upper surface of said photoresist filling said cavities together define a contiguous planar surface.

Optionally, the method further comprises the step of:

thermally reflowing said photoresist to facilitate complete filling of said cavities.

Optionally, step (b)(ii) is performed by chemical mechanical planarization or by photoresist etching.

Optionally, the method further comprises the step of:

(d) defining nozzle apertures through said first and second nozzle plates.

Optionally, each nozzle comprises a nozzle chamber formed on a substrate, said nozzle chamber comprising a roof spaced apart from said substrate and sidewalls extending between said roof and said substrate, wherein said first nozzle plate and said sidewalls are comprised of the same material.

The printhead according to the invention comprises a plurality of nozzles, and typically a chamber and actuator (e.g. heater element) corresponding to each nozzle. The smallest repeating units of the printhead will generally have an ink supply inlet feeding ink to one or more chambers. An entire nozzle array is formed by repeating these individual units. Such an individual unit is generally referred to herein as a "unit cell". A printhead may be comprised of a plurality of printhead integrated circuits, each printhead integrated circuit comprising a plurality of nozzles.

As used herein, the term "ink" is used to signify any ejectable liquid, and is not limited to conventional inks containing colored dyes. Examples of non-colored inks include fixatives, infra-red absorber inks, functionalized chemicals, adhesives, biological fluids, medicaments, water and other solvents, and so on. The ink or ejectable liquid also need not necessarily be a strictly a liquid, and may contain a suspension of solid particles.

BRIEF DESCRIPTION OF THE DRAWINGS

Embodiments of the present invention will now be described by way of example only with reference to the accompanying drawings, in which.

DETAILED DESCRIPTION OF THE PREFERRED EMBODIMENTS

Figure 36:
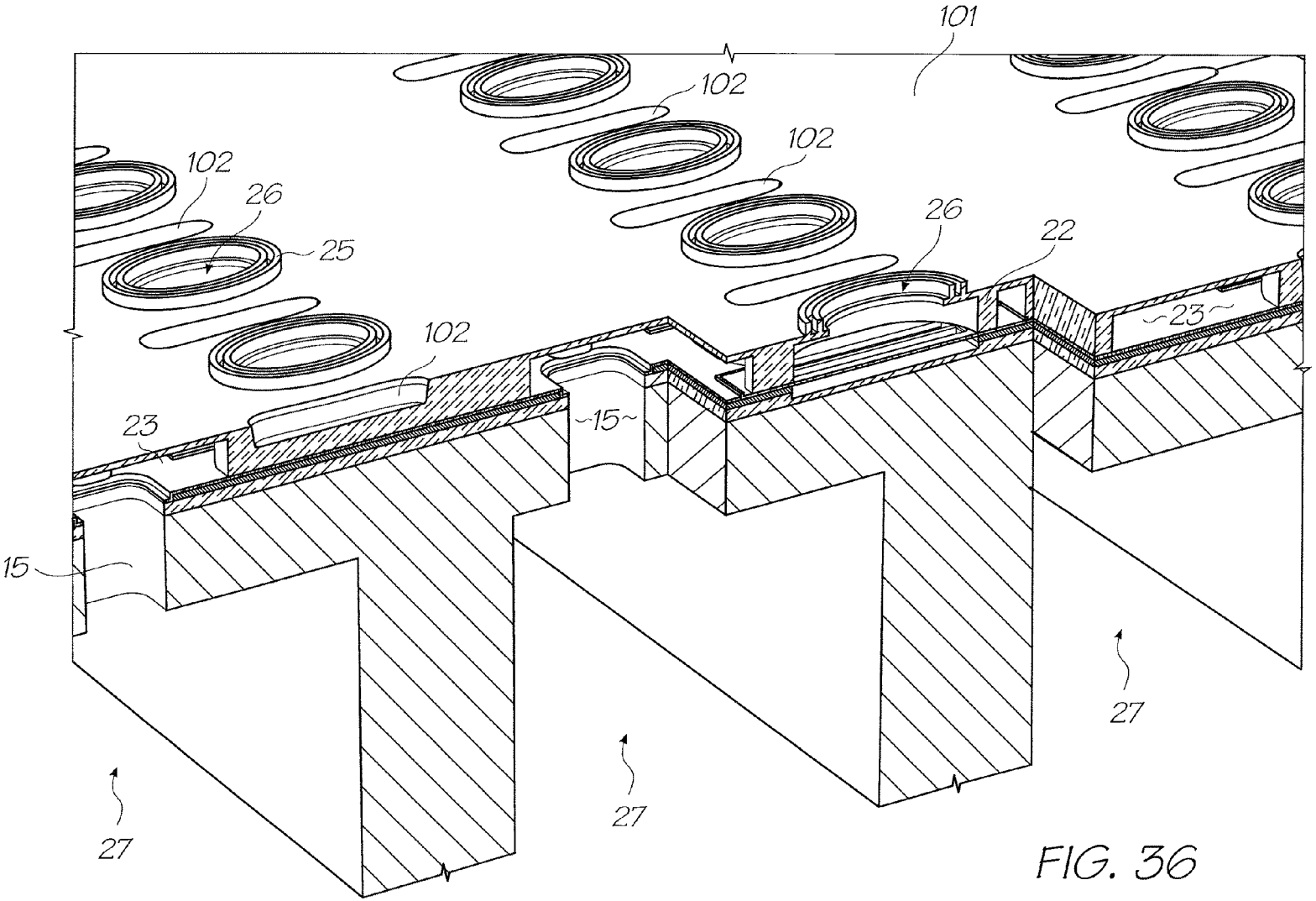
FIG. 36 is a cutaway perspective of an array of nozzles on a printhead integrated circuit.

Referring initially to FIG. 36, there is shown a cutaway perspective view of a MEMS printhead integrated circuit, as described in our earlier U.S. application Ser. No. 11/246,684 (filed Oct. 11, 2005), the contents of which is herein incorporated by reference. As shown in FIG. 36, each row of nozzles has a respective ink supply channel 27 extending along its length and supplying ink to a plurality of ink inlets 15 in each row. The ink inlets, in turn, supply ink to an ink conduit 23 for each row, with each nozzle chamber receiving ink from a common ink conduit extending longitudinally along each row. Nozzle apertures 26, having a respective nozzle rim 25, are defined in a nozzle plate 101, which spans across the rows and columns of nozzles. As will be explained in more detail below, the nozzle plate 101 is formed by PECVD of a ceramic material (e.g. silicon nitride) onto a photoresist scaffold. By virtue of this deposition process, the nozzle plate 101 has a plurality of cavities 102 defined therein. The cavities 102 are disposed in between adjacent nozzle in a row. These cavities 102 are typically several microns deep (e.g. 1-5 microns deep) and introduce discontinuities into the nozzle plate 101. The overall effect is a nozzle plate, which is substantially non-planar by virtue of these cavities 102.

Depending on the particular nozzle design and manufacturing process, the cavities 102 may be substantially larger (wider, longer or deeper) than is illustrated in FIG. 36. They may extend significantly between rows or columns of nozzles.

The discontinuity or non-planarity arising from the cavities 102 in the nozzle plate 101 is disadvantageous for several reasons. Firstly, the cavities 102 are points of weakness in the nozzle plate 101 and reduce the overall mechanical robustness of the printhead, particularly with respect to sheer forces imparted across the nozzle plate. This is especially significant, because wiping actions across the surface of the nozzle plate 101 (as may be used during some types of printhead maintenance) cause relatively high sheer forces. Secondly, the cavities 102 can easily trap ink and/or particulates, which are then difficult to remove. The proximity of the cavities 102 to the nozzle apertures 26 is especially undesirable, because any trapped particulates are more likely to obscure nozzles and affect print quality.

For a complete understanding of the present invention, there now follows a description of how the printhead integrated circuit shown in FIG. 36 is formed by a MEMS manufacturing process. In addition, there is described an alternative manufacturing process, in accordance with the present invention, in which the planarity of the nozzle plate 101 is significantly improved.

MEMS Manufacturing Process

Figure 2:
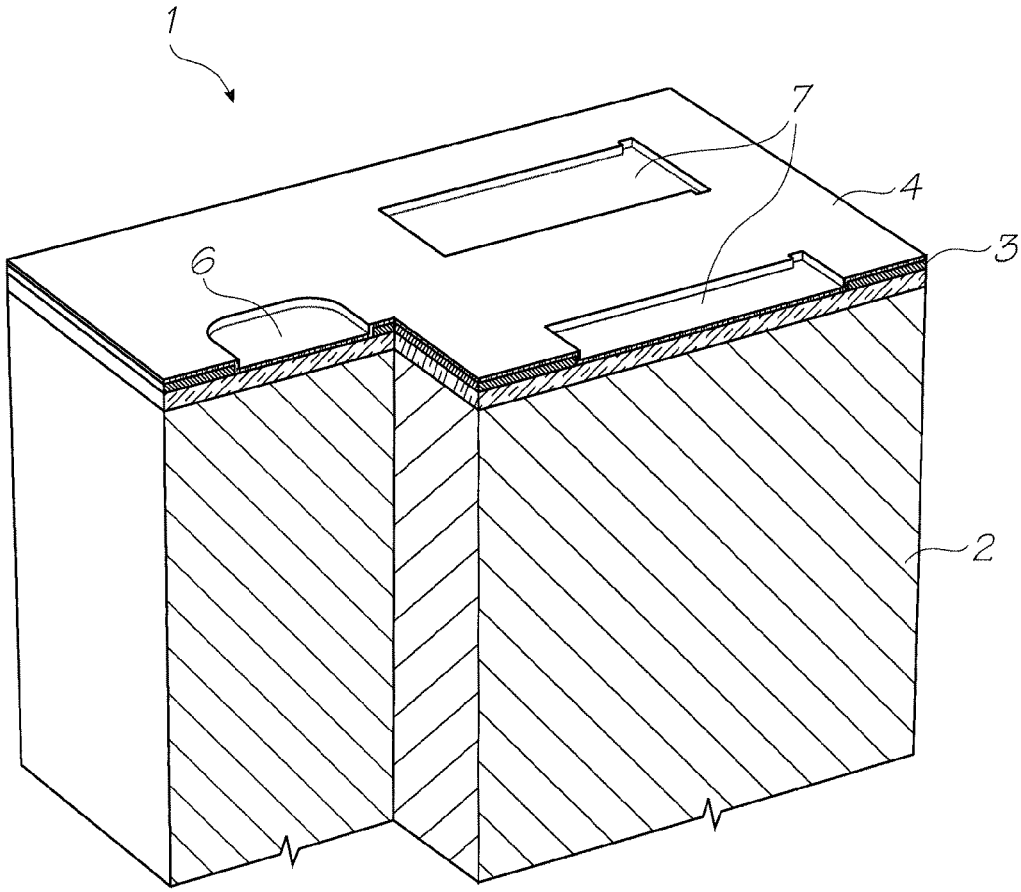
FIG. 2 shows a perspective of the partially fabricated unit cell of FIG. 1.

The MEMS manufacturing process builds up nozzle structures on a silicon wafer after the completion of CMOS processing. FIG. 2 is a cutaway perspective view of a nozzle unit cell 100 after the completion of CMOS processing and before MEMS processing.

During CMOS processing of the wafer, four metal layers are deposited onto a silicon wafer 2, with the metal layers being interspersed between interlayer dielectric (ILD) layers. The four metal layers are referred to as M1, M2, M3 and M4 layers and are built up sequentially on the wafer during CMOS processing. These CMOS layers provide all the drive circuitry and logic for operating the printhead.

In the completed printhead, each heater element actuator is connected to the CMOS via a pair of electrodes defined in the outermost M4 layer. Hence, the M4 CMOS layer is the foundation for subsequent MEMS processing of the wafer. The M4 layer also defines bonding pads along a longitudinal edge of each printhead integrated circuit. These bonding pads (not shown) allow the CMOS to be connected to a microprocessor via wire bonds extending from the bonding pads.

Figure 1:
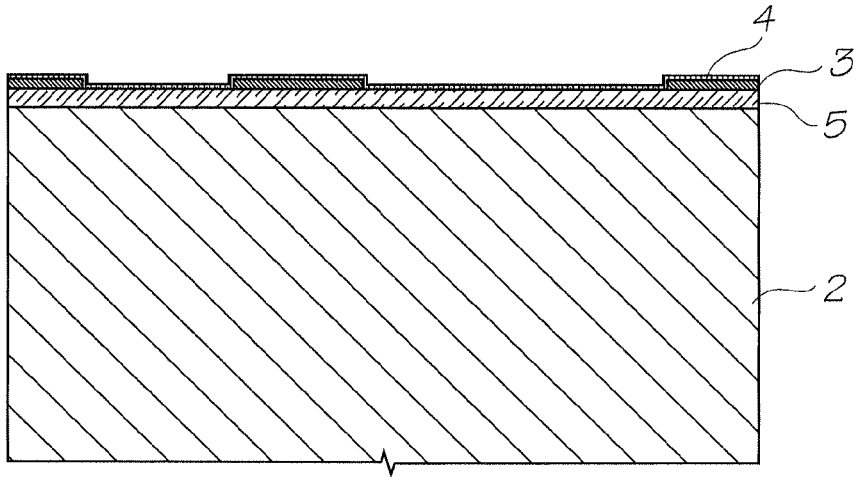
FIG. 1 shows a partially fabricated unit cell of the MEMS nozzle array on a printhead according to the present invention, the unit cell being section along A-A of FIG. 3.

FIGS. 1 and 2 show the aluminium M4 layer 3 having a passivation layer 4 deposited thereon. (Only MEMS features of the M4 layer are shown in these Figures; the main CMOS features of the M4 layer are positioned outside the nozzle unit cell). The M4 layer 3 has a thickness of 1 micron and is itself deposited on a 2 micron layer of CVD oxide 5. As shown in FIGS. 1 and 2, the M4 layer 3 has an ink inlet opening 6 and pit openings 7. These openings define the positions of the ink inlet and pits formed subsequently in the MEMS process.

Before MEMS processing of the unit cell 1 begins, bonding pads along a longitudinal edge of each printhead integrated circuit are defined by etching through the passivation layer 4. This etch reveals the M4 layer 3 at the bonding pad positions. The nozzle unit cell 1 is completely masked with photoresist for this step and, hence, is unaffected by the etch.

Figure 3:
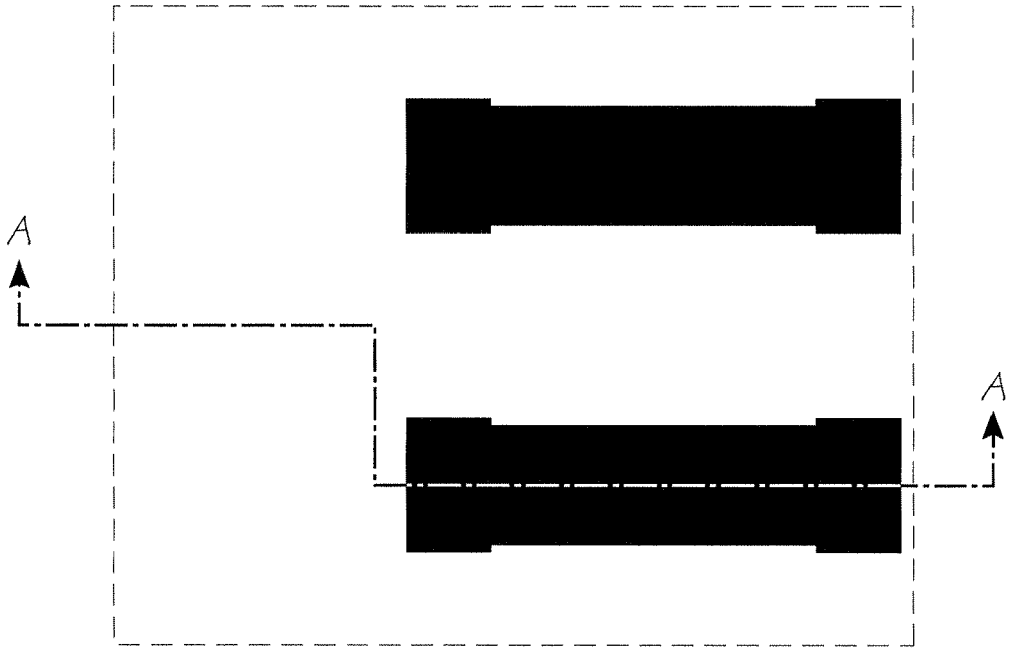
FIG. 3 shows the mark associated with the etch of the heater element trench.
Figure 4:
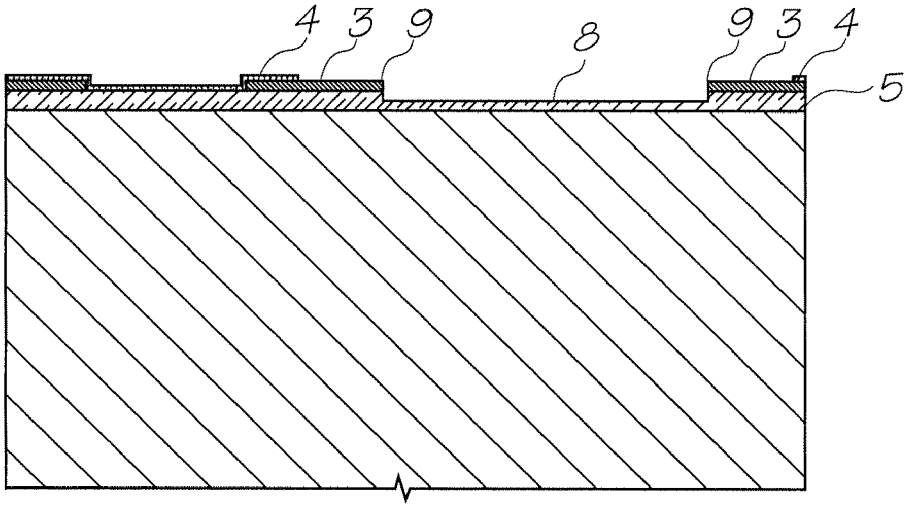
FIG. 4 is a sectioned view of the unit cell after the etch of the trench.
Figure 5:
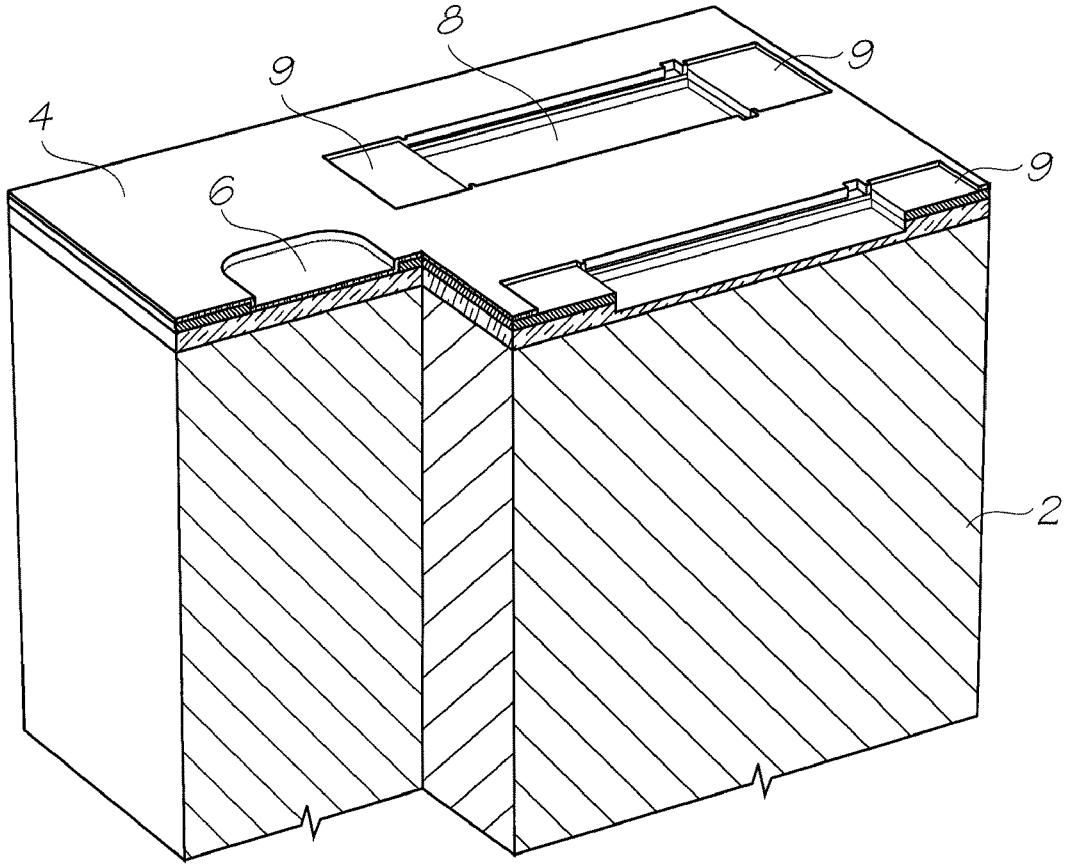
FIG. 5 is a perspective view of the unit cell shown in FIG. 4.

Turning to FIGS. 3 to 5, the first stage of MEMS processing etches a pit 8 through the passivation layer 4 and the CVD oxide layer 5. This etch is defined using a layer of photoresist (not shown) exposed by the dark tone pit mask shown in FIG. 3. The pit 8 has a depth of 2 microns, as measured from the top of the M4 layer 3. At the same time as etching the pit 8, electrodes 9 are defined on either side of the pit by partially revealing the M4 layer 3 through the passivation layer 4. In the completed nozzle, a heater element is suspended across the pit 8 between the electrodes 9.

In the next step (FIGS. 6 to 8), the pit 8 is filled with a first sacrificial layer ("SAC1") of photoresist 10. A 2 micron layer of high viscosity photoresist is first spun onto the wafer and then exposed using the dark tone mask shown in FIG. 6. The SAC1 photoresist 10 forms a scaffold for subsequent deposition of the heater material across the electrodes 9 on either side of the pit 8. Consequently, it is important the SAC1 photoresist 10 has a planar upper surface that is flush with the upper surface of the electrodes 9. At the same time, the SAC1 photoresist must completely fill the pit 8 to avoid 'stringers' of conductive heater material extending across the pit and shorting out the electrodes 9.

Typically, when filling trenches with photoresist, it is necessary to expose the photoresist outside the perimeter of the trench in order to ensure that photoresist fills against the walls of the trench and, therefore, avoid 'stringers' in subsequent deposition steps. However, this technique results in a raised (or spiked) rim of photoresist around the perimeter of the trench. This is undesirable because in a subsequent deposition step, material is deposited unevenly onto the raised rim—vertical or angled surfaces on the rim will receive less deposited material than the horizontal planar surface of the photoresist filling the trench. The result is 'resistance hotspots' in regions where material is thinly deposited.

Figure 6:
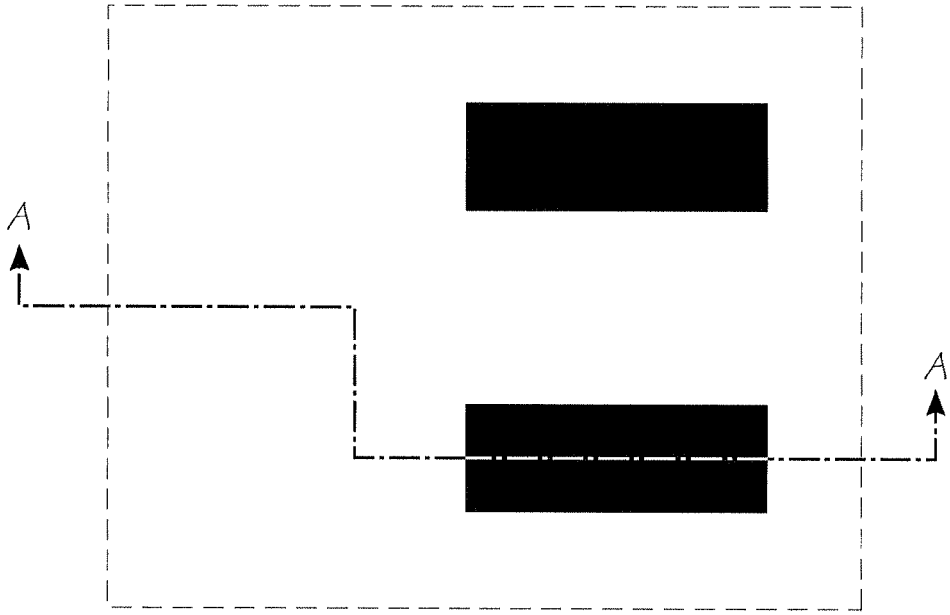
FIG. 6 is the mask associated with the deposition of sacrificial photoresist shown in FIG. 7.
Figure 7:
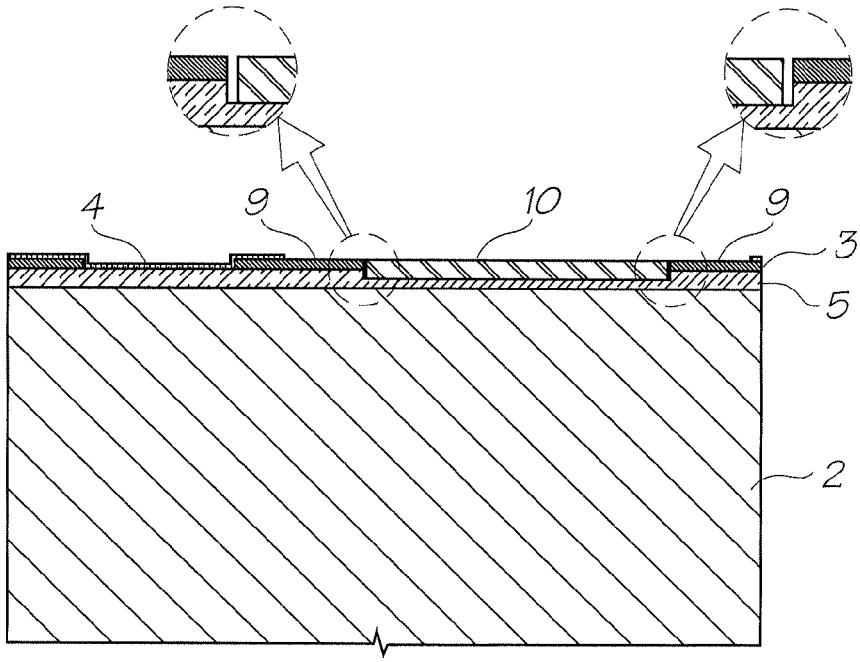
FIG. 7 shows the unit cell after the deposition of sacrificial photoresist trench, with partial enlargements of the gaps between the edges of the sacrificial material and the side walls of the trench.
Figure 8:
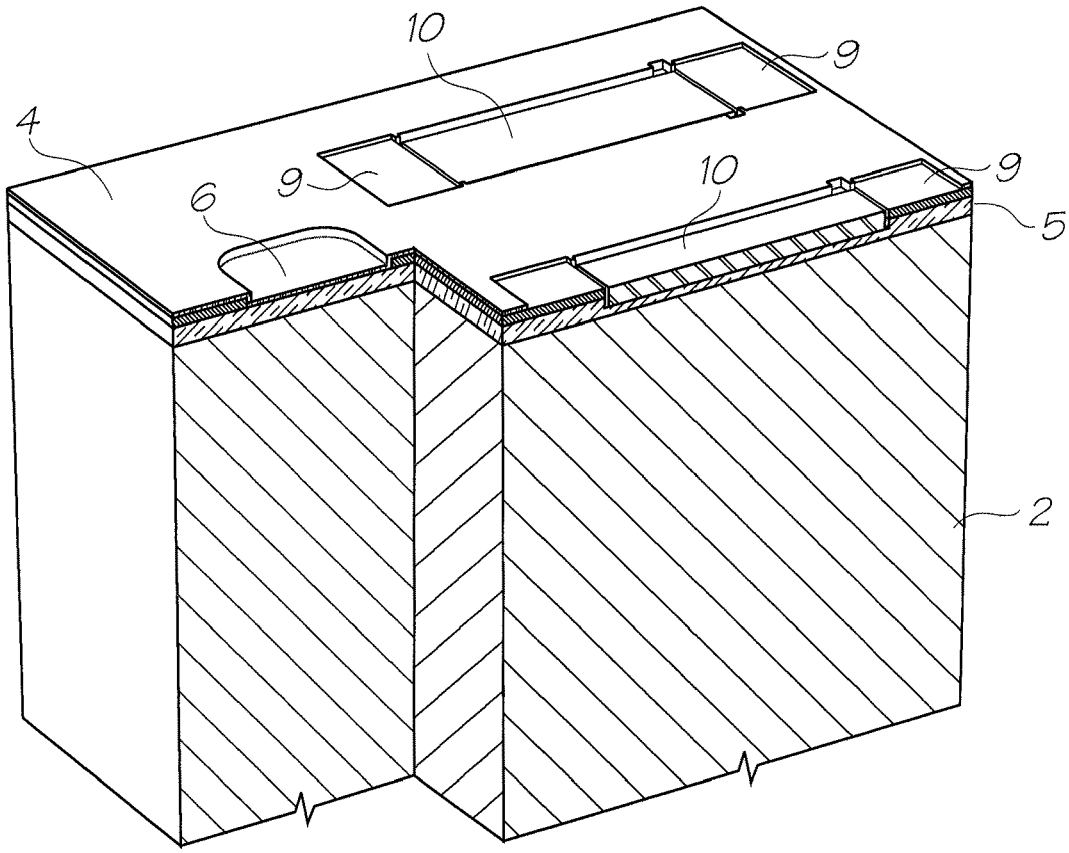
FIG. 8 is a perspective of the unit cell shown in FIG. 7.

As shown in FIG. 7, the present process deliberately exposes the SAC1 photoresist 10 inside the perimeter walls of the pit 8 (e.g. within 0.5 microns) using the mask shown in FIG. 6. This ensures a planar upper surface of the SAC1 photoresist 10 and avoids any spiked regions of photoresist around the perimeter rim of the pit 8.

Figure 9:
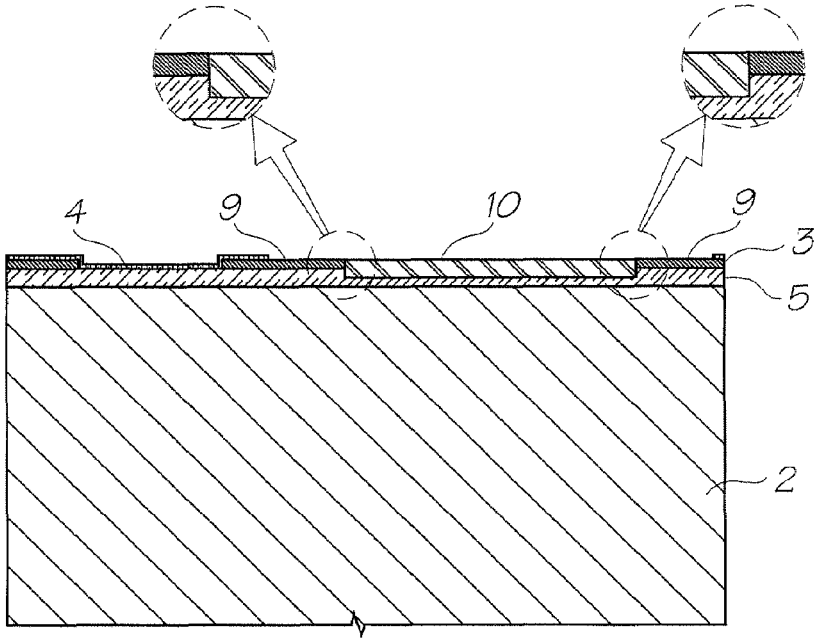
FIG. 9 shows the unit cell following the reflow of the sacrificial photoresist to close the gaps along the side walls of the trench.
Figure 10:
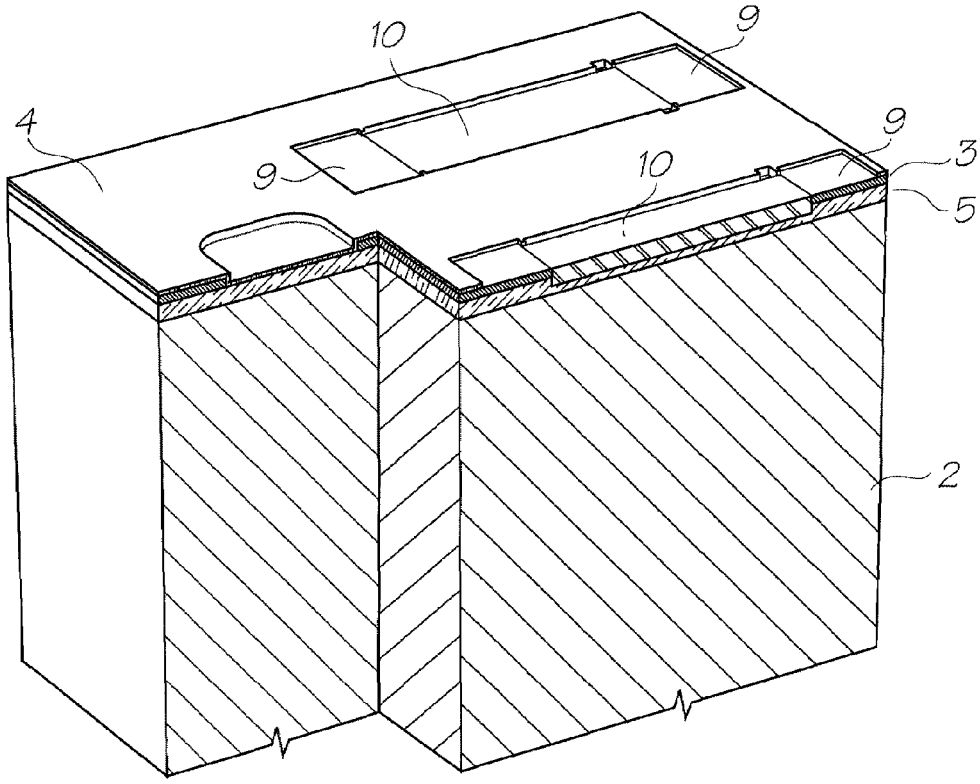
FIG. 10 is a perspective of the unit cell shown in FIG. 9.

After exposure of the SAC1 photoresist 10, the photoresist is reflowed by heating. Reflowing the photoresist allows it to flow to the walls of the pit 8, filling it exactly. FIGS. 9 and 10 show the SAC1 photoresist 10 after reflow. The photoresist has a planar upper surface and meets flush with the upper surface of the M4 layer 3, which forms the electrodes 9. Following reflow, the SAC1 photoresist 10 is U.V. cured and/or hardbaked to avoid any reflow during the subsequent deposition step of heater material.

Figure 11:
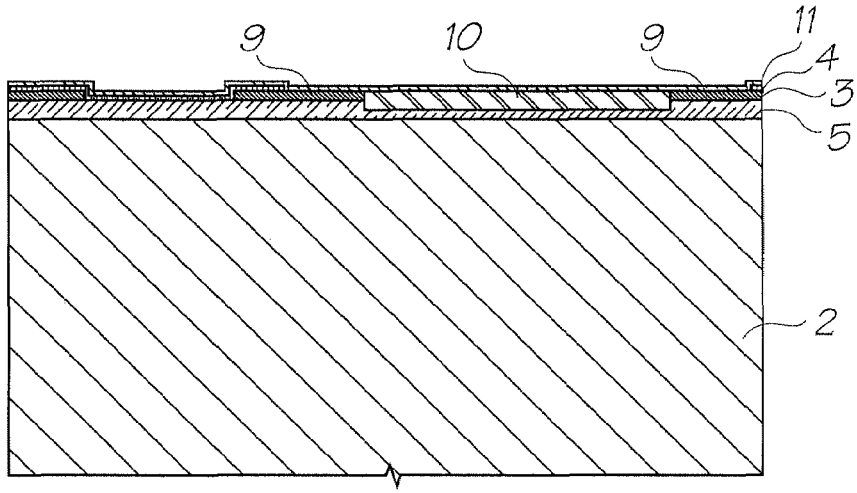
FIG. 11 is a section view showing the deposition of the heater material layer.
Figure 12:
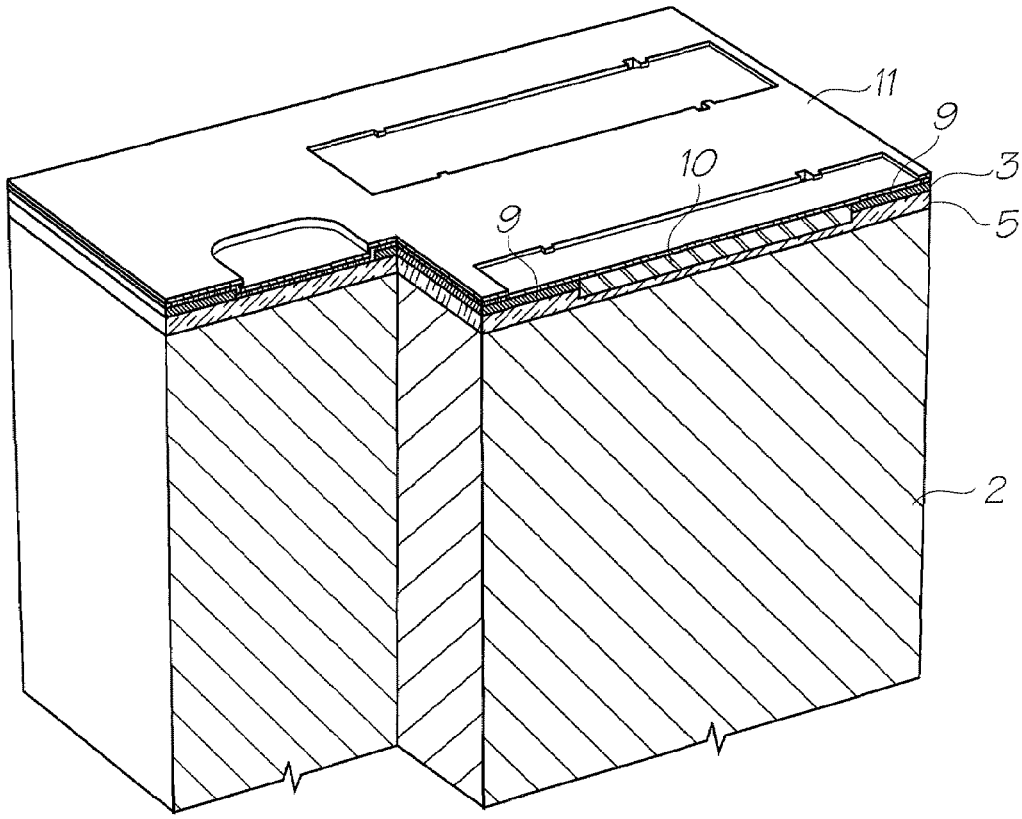
FIG. 12 is a perspective of the unit cell shown in FIG. 11.

FIGS. 11 and 12 show the unit cell after deposition of the 0.5 microns of heater material 11 onto the SAC1 photoresist 10. Due to the reflow process described above, the heater material 11 is deposited evenly and in a planar layer over the electrodes 9 and the SAC1 photoresist 10. The heater material may be comprised of any suitable conductive material, such as TiAl, TiN, TiAlN, TiAlSiN etc. A typical heater material deposition process may involve sequential deposition of a 100 Å seed layer of TiAl, a 2500 Å layer of TiAlN, a further 100 Å seed layer of TiAl and finally a further 2500 Å layer of TiAlN.

Figure 13:
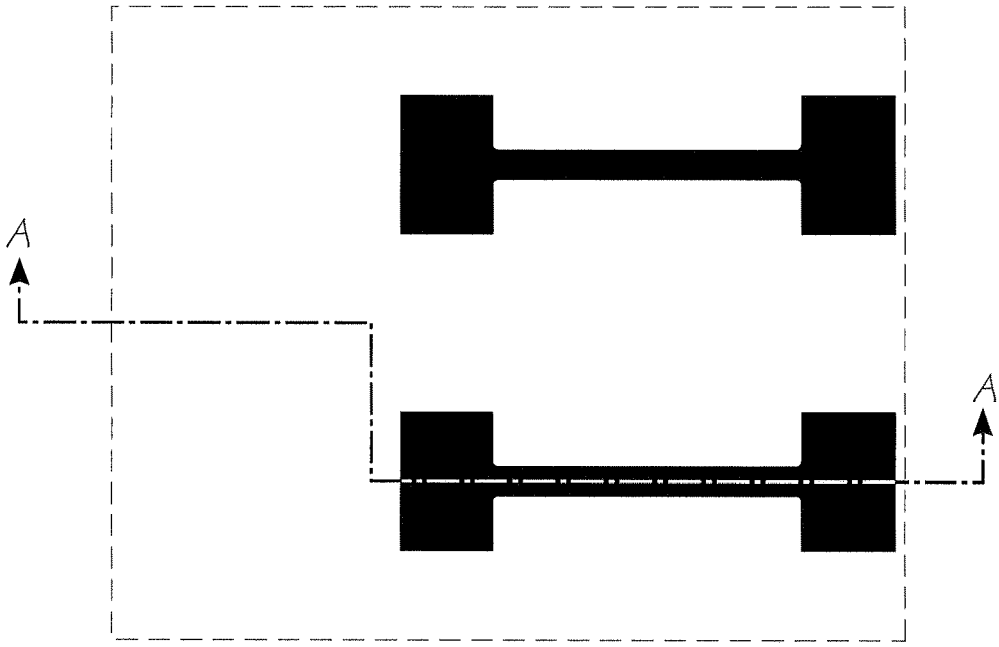
FIG. 13 is the mask associated with the metal etch of the heater material shown in FIG. 14.
Figure 14:
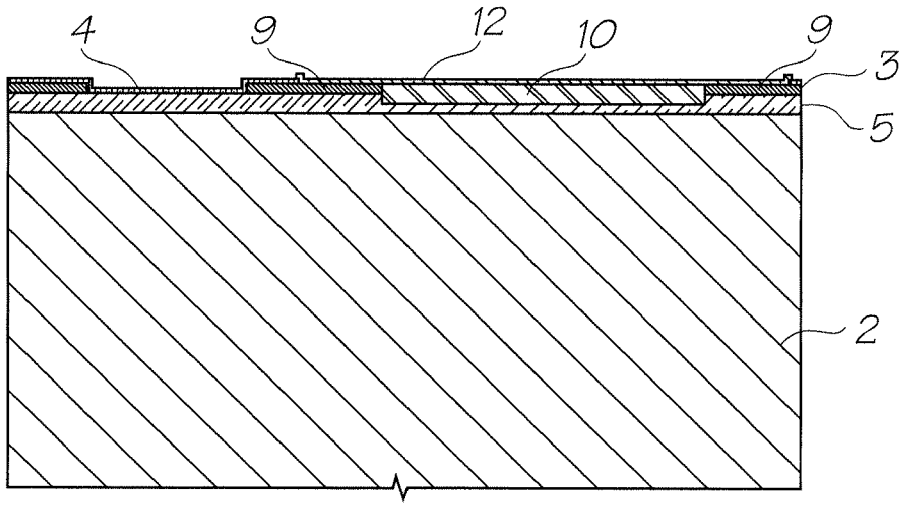
FIG. 14 is a section view showing the metal etch to shape the heater actuators.
Figure 15:
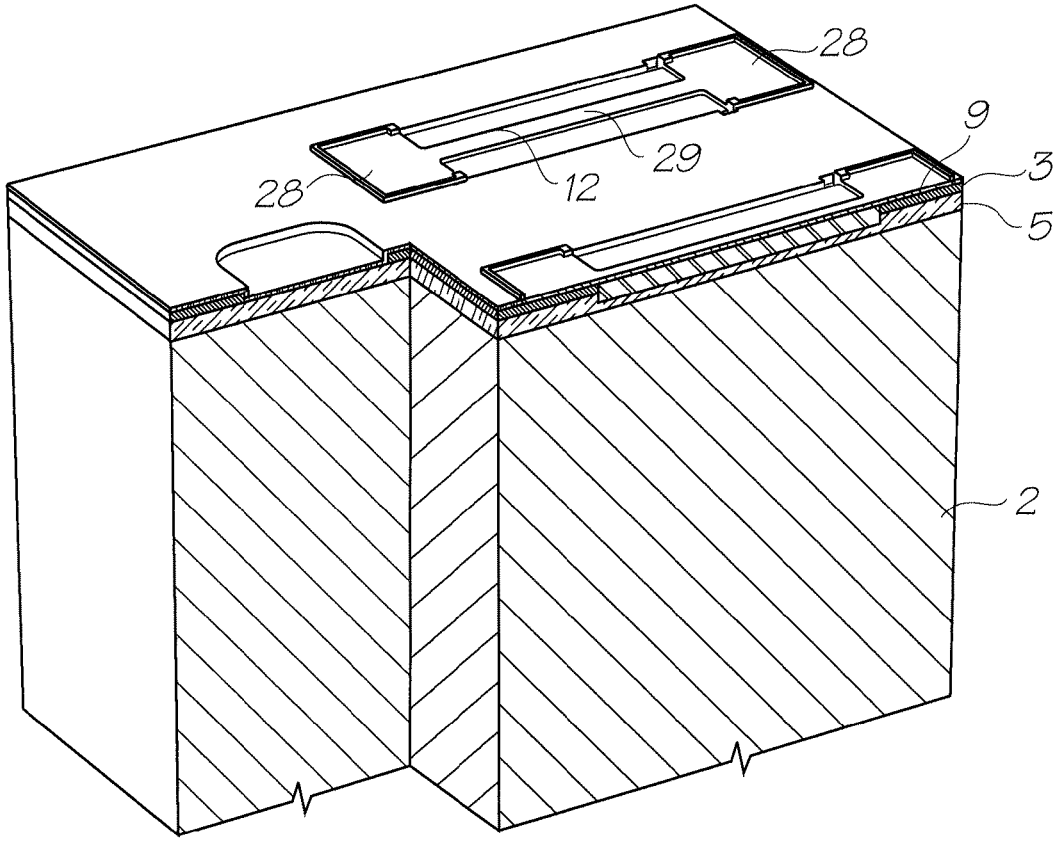
FIG. 15 is a perspective of the unit cell shown in FIG. 14.

Referring to FIGS. 13 to 15, in the next step, the layer of heater material 11 is etched to define the thermal actuator 12. Each actuator 12 has contacts 28 that establish an electrical connection to respective electrodes 9 on either side of the SAC1 photoresist 10. A heater element 29 spans between its corresponding contacts 28.

This etch is defined by a layer of photoresist (not shown) exposed using the dark tone mask shown in FIG. 13. As shown in FIG. 15, the heater element 12 is a linear beam spanning between the pair of electrodes 9. However, the heater element 12 may alternatively adopt other configurations, such as those described in Applicant's U.S. Pat. No. 6,755,509, the content of which is herein incorporated by reference.

In the next sequence of steps, an ink inlet for the nozzle is etched through the passivation layer 4, the oxide layer 5 and the silicon wafer 2. During CMOS processing, each of the metal layers had an ink inlet opening (see, for example, opening 6 in the M4 layer 3 in FIG. 1) etched therethrough in preparation for this ink inlet etch. These metal layers, together with the interspersed ILD layers, form a seal ring for the ink inlet, preventing ink from seeping into the CMOS layers.

Figure 16:
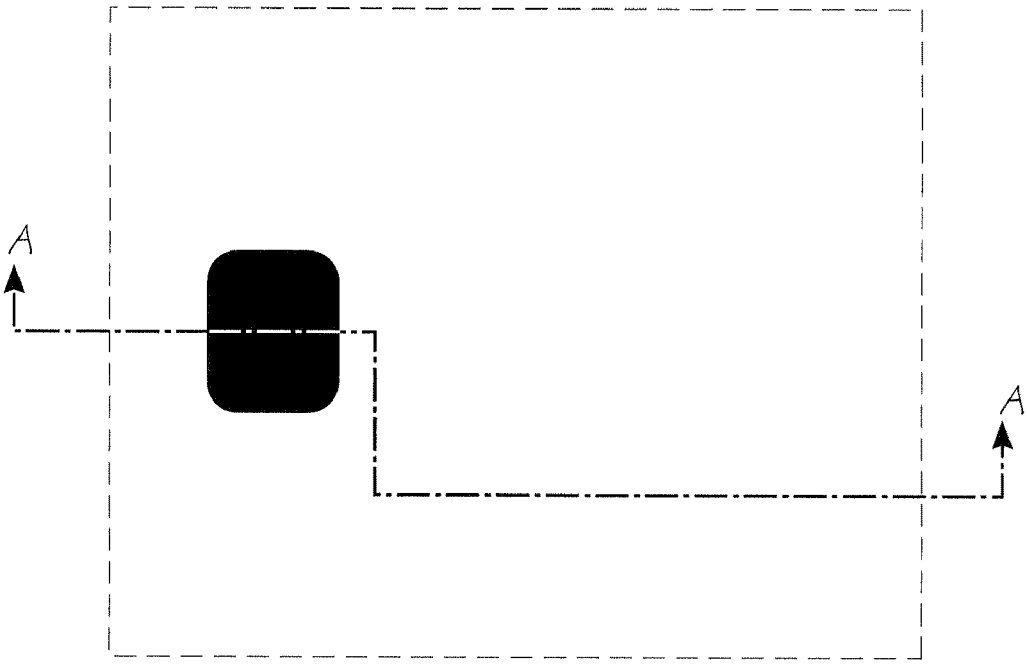
FIG. 16 is the mask associated with the etch shown in FIG. 17.
Figure 17:
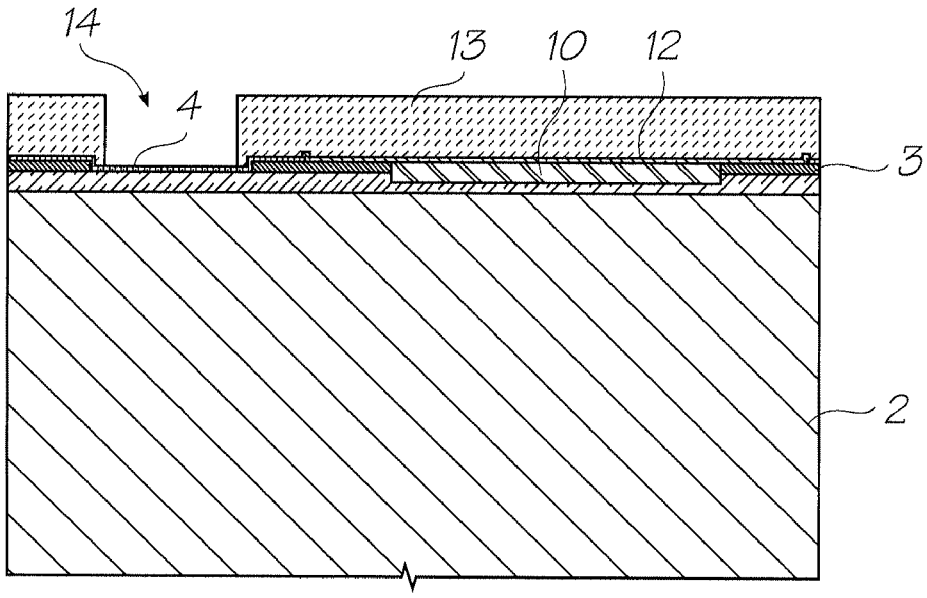
FIG. 17 shows the deposition of the photoresist layer and subsequent etch of the ink inlet to the passivation layer on top of the CMOS drive layers.
Figure 18:
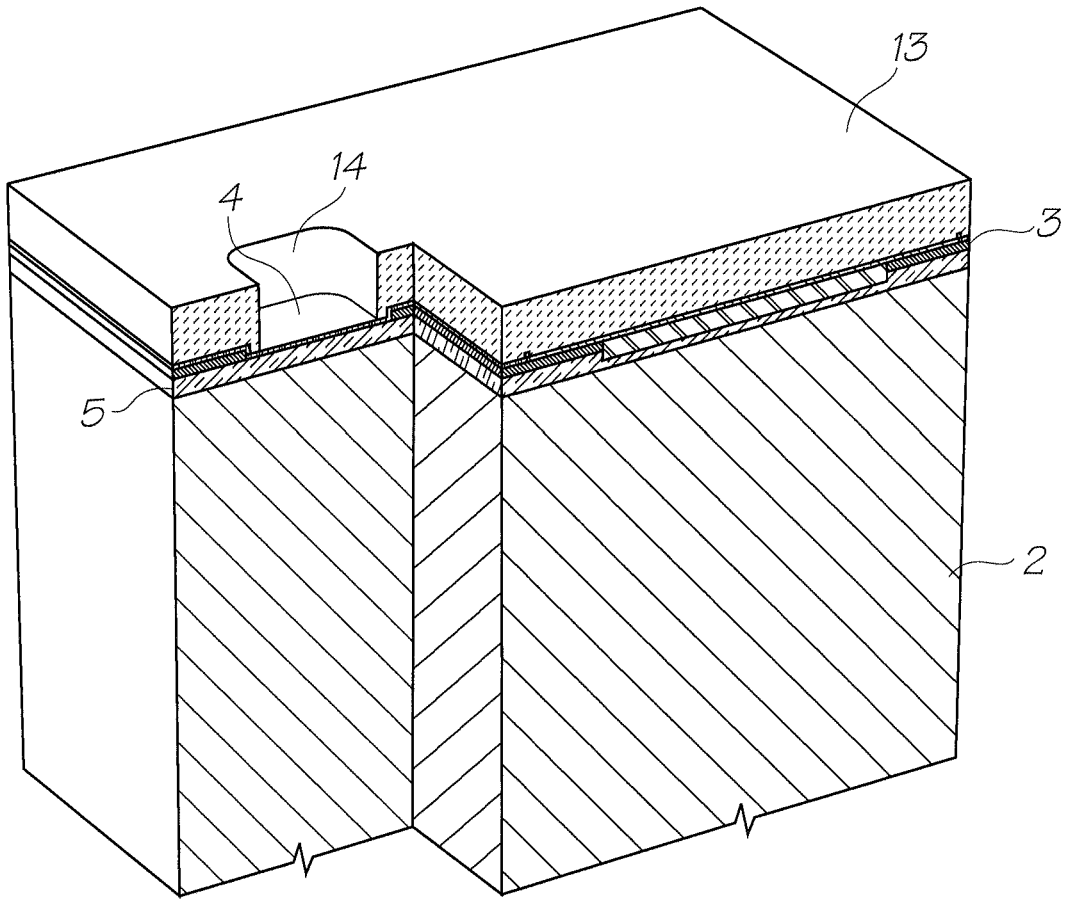
FIG. 18 is a perspective of the unit cell shown in FIG. 17.

Referring to FIGS. 16 to 18, a relatively thick layer of photoresist 13 is spun onto the wafer and exposed using the dark tone mask shown in FIG. 16. The thickness of photoresist 13 required will depend on the selectivity of the deep reactive ion etch (DRIE) used to etch the ink inlet. With an ink inlet opening 14 defined in the photoresist 13, the wafer is ready for the subsequent etch steps.

Figure 19:
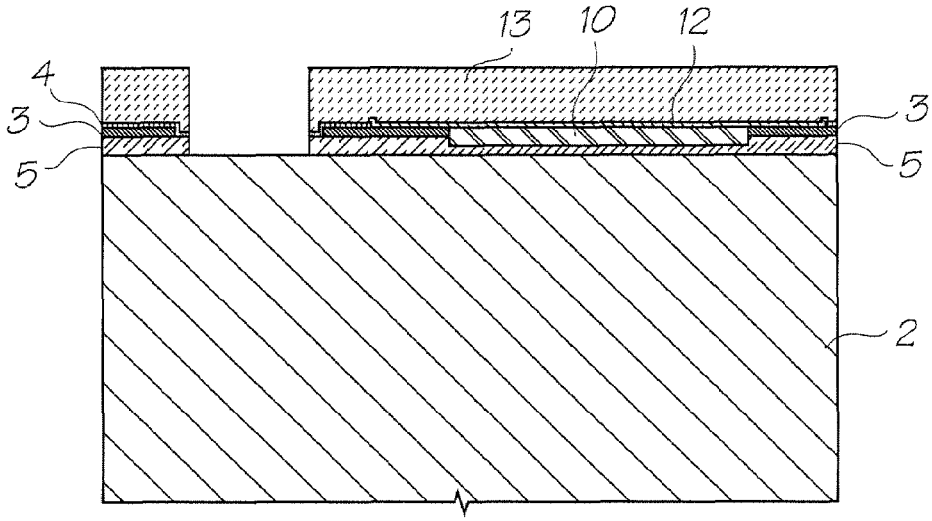
FIG. 19 shows the oxide etch through the passivation and CMOS layers to the underlying silicon wafer.
Figure 20:
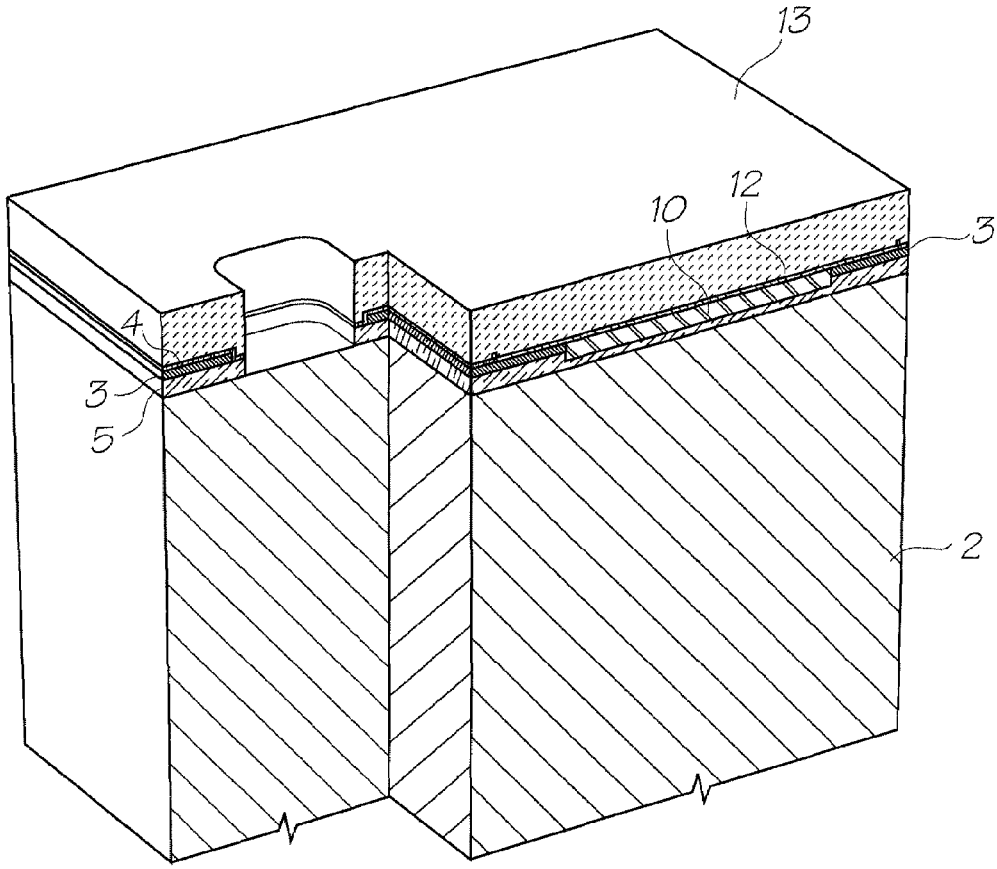
FIG. 20 is a perspective of the unit cell shown in FIG. 19.

In the first etch step (FIGS. 19 and 20), the dielectric layers (passivation layer 4 and oxide layer 5) are etched through to the silicon wafer below. Any standard oxide etch (e.g. $O_2/C_4F_8$ plasma) may be used.

Figure 21:
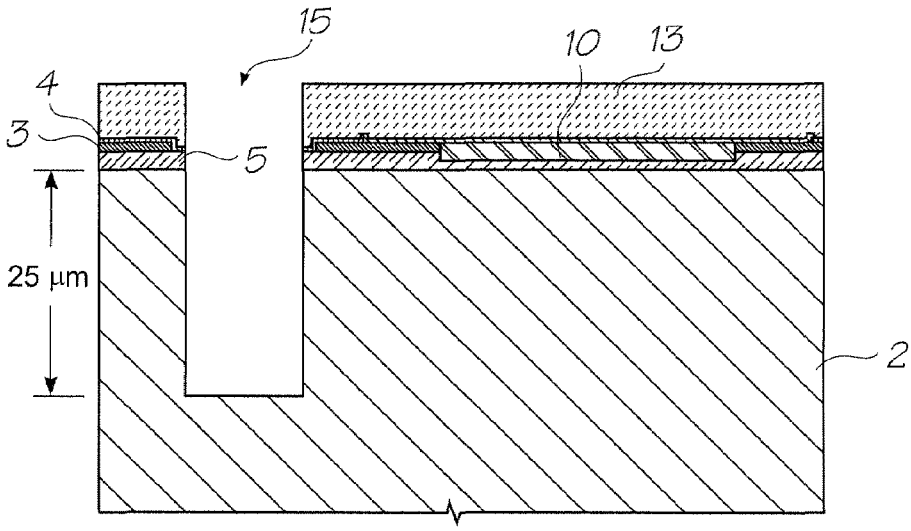
FIG. 21 is the deep anisotropic etch of the ink inlet into the silicon wafer.
Figure 22:
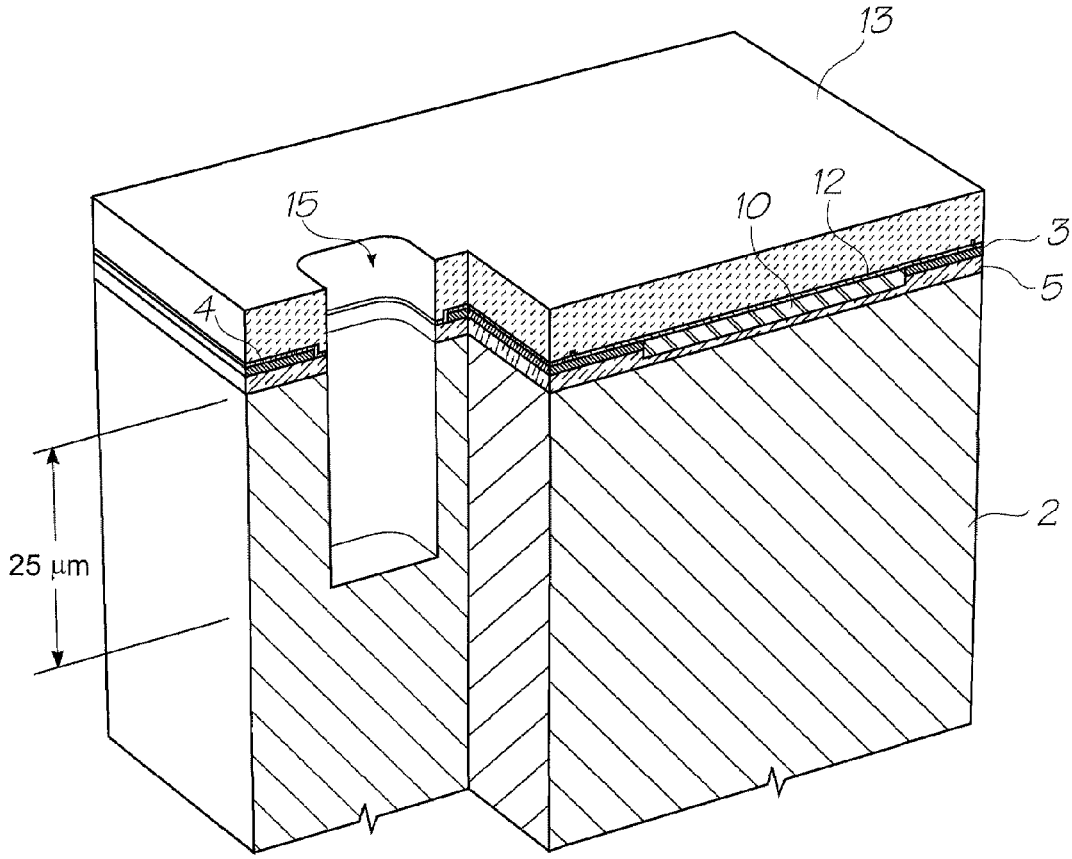
FIG. 22 is a perspective of the unit cell shown in FIG. 21.

In the second etch step (FIGS. 21 and 22), an ink inlet 15 is etched through the silicon wafer 2 to a depth of 25 microns, using the same photoresist mask 13. Any standard anisotropic DRIE, such as the Bosch etch (see U.S. Pat. Nos. 6,501,893 and 6,284,148) may be used for this etch. Following etching of the ink inlet 15, the photoresist layer 13 is removed by plasma ashing.

Figure 23:
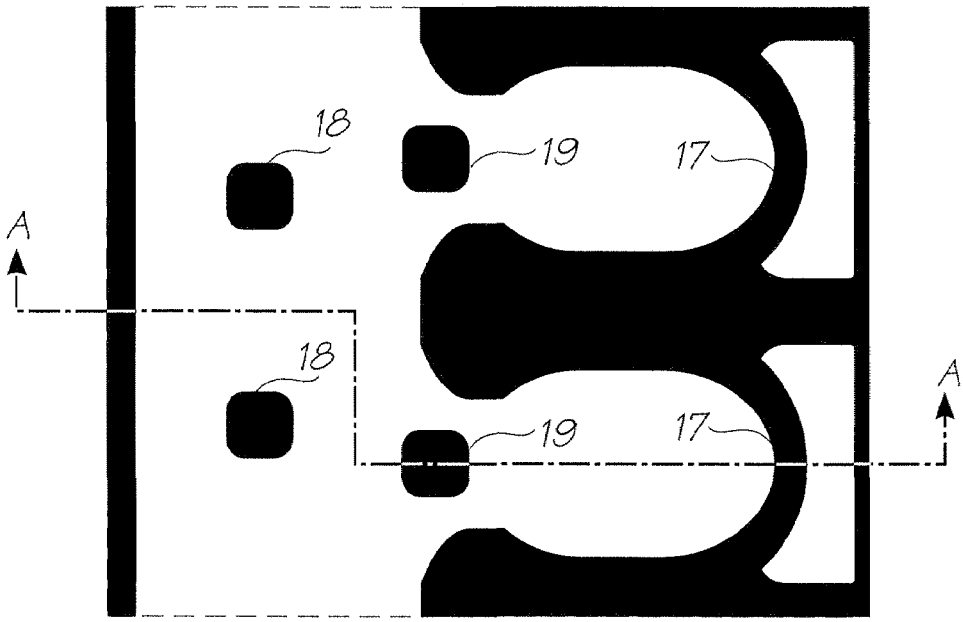
FIG. 23 is the mask associated with the photoresist etch shown in FIG. 24.
Figure 24:
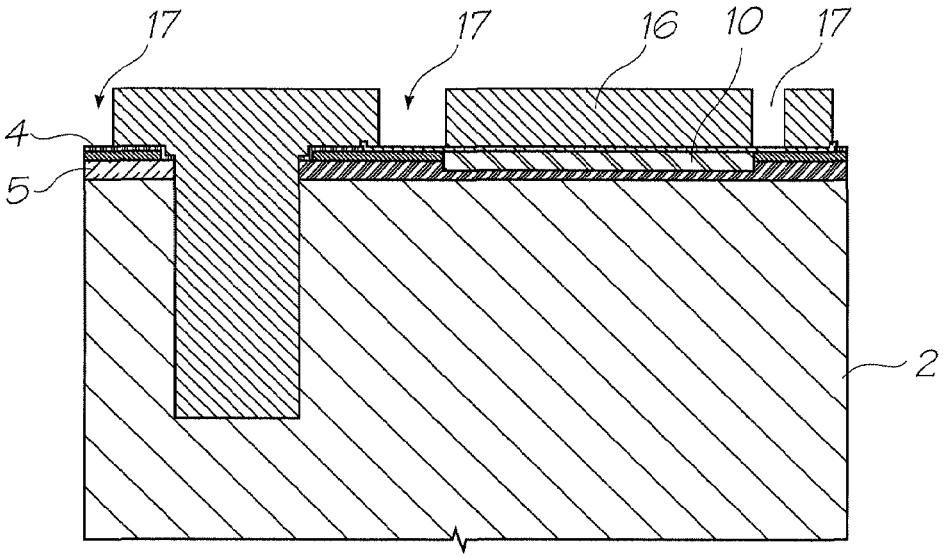
FIG. 24 shows the photoresist etch to form openings for the chamber roof and side walls.
Figure 25:
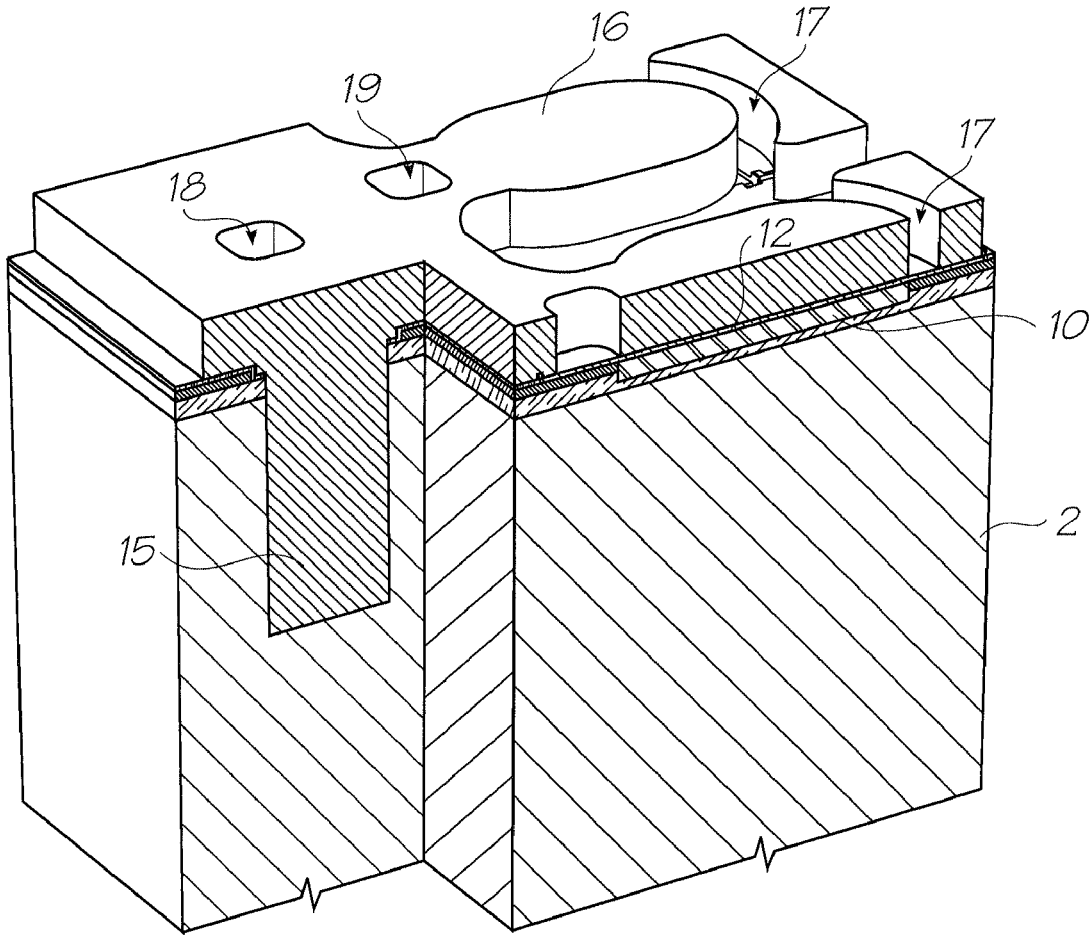
FIG. 25 is a perspective of the unit cell shown in FIG. 24.

In the next step, the ink inlet 15 is plugged with photoresist and a second sacrificial layer ("SAC2") of photoresist 16 is built up on top of the SAC1 photoresist 10 and passivation layer 4. The SAC2 photoresist 16 will serve as a scaffold for subsequent deposition of roof material, which forms a roof and sidewalls for each nozzle chamber. Referring to FIGS. 23 to 25, a 6 micron layer of high viscosity photoresist is spun onto the wafer and exposed using the dark tone mask shown in FIG. 23.

As shown in FIGS. 23 and 25, the mask exposes sidewall openings 17 in the SAC2 photoresist 16 corresponding to the positions of chamber sidewalls and sidewalls for an ink conduit. In addition, openings 18 and 19 are exposed adjacent the plugged inlet 15 and nozzle chamber entrance respectively. These openings 18 and 19 will be filled with roof material in the subsequent roof deposition step and provide unique advantages in the present nozzle design. Specifically, the openings 18 filled with roof material act as priming features, which assist in drawing ink from the inlet 15 into each nozzle chamber. The openings 19 filled with roof material act as filter structures and fluidic cross talk barriers. These help prevent air bubbles from entering the nozzle chambers and diffuses pressure pulses generated by the thermal actuator 12.

Figure 26:
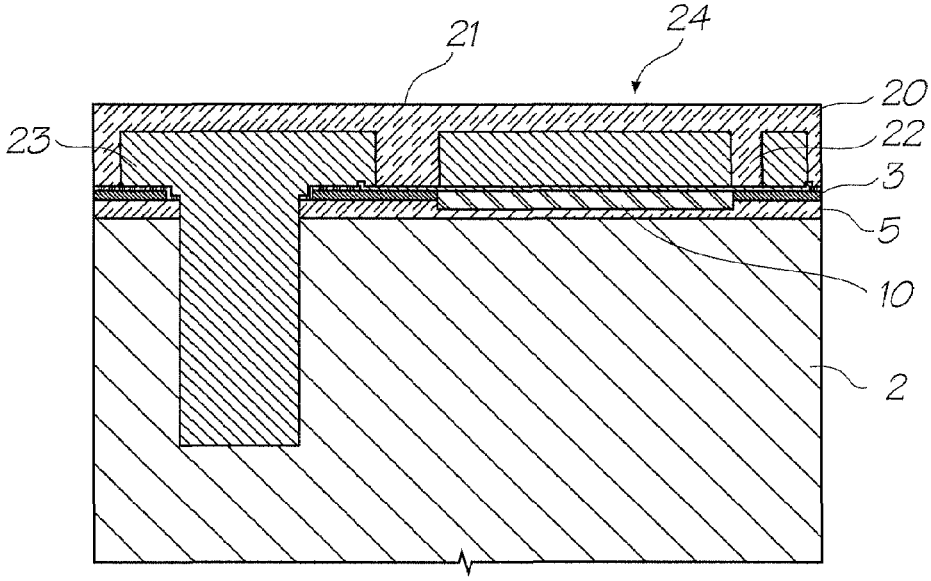
FIG. 26 shows the deposition of the side wall and risk material.
Figure 27:
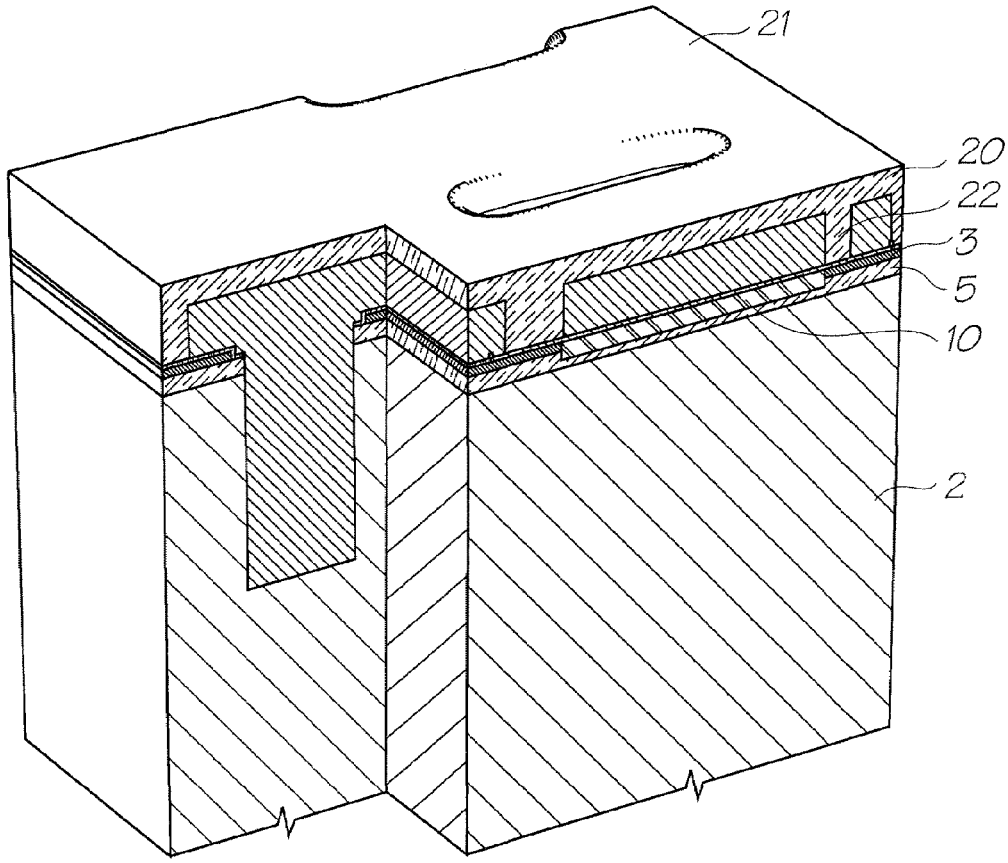
FIG. 27 is a perspective of the unit cell shown in FIG. 26.

Referring to FIGS. 26 and 27, the next stage deposits 3 microns of roof material 20 onto the SAC2 photoresist 16 by PECVD. The roof material 20 fills the openings 17, 18 and 19 in the SAC2 photoresist 16 to form nozzle chambers 24 having a roof 21 and sidewalls 22. An ink conduit 23 for supplying ink into each nozzle chamber is also formed during deposition of the roof material 20. In addition, any priming features and filter structures (not shown in FIGS. 26 and 27) are formed at the same time. The roofs 21, each corresponding to a respective nozzle chamber 24, span across adjacent nozzle chambers in a row to form a nozzle plate. The roof material 20 may be comprised of any suitable material, such as silicon nitride, silicon oxide, silicon oxynitride, aluminium nitride etc. As discussed above, the nozzle plate 101 has cavities 102 (shown in FIG. 36) in regions between nozzles.

Figure 28:
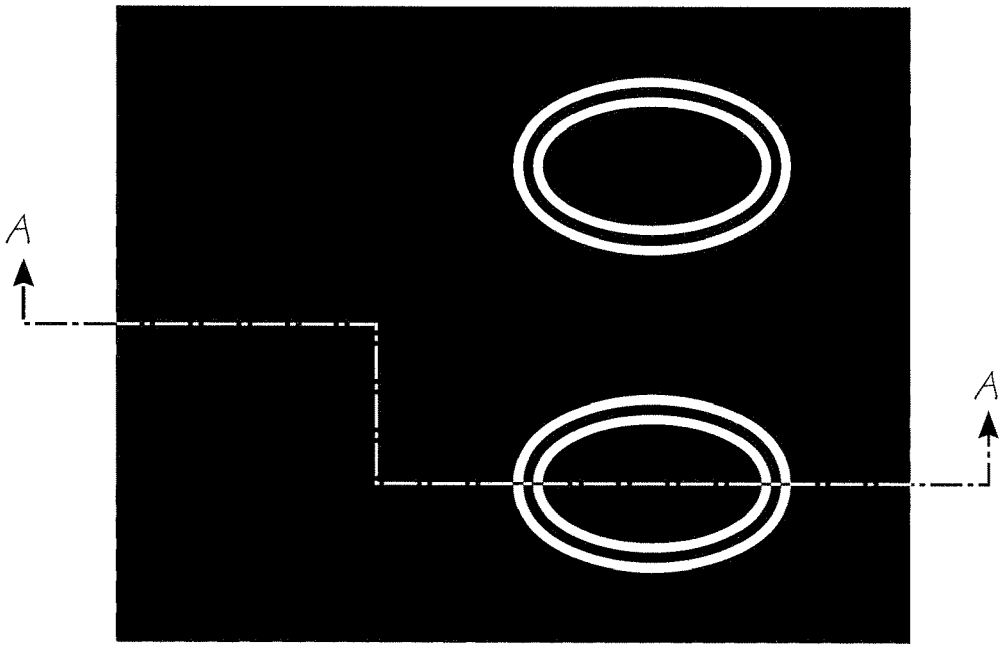
FIG. 28 is the mask associated with the nozzle rim etch shown in FIG. 29.
Figure 29:
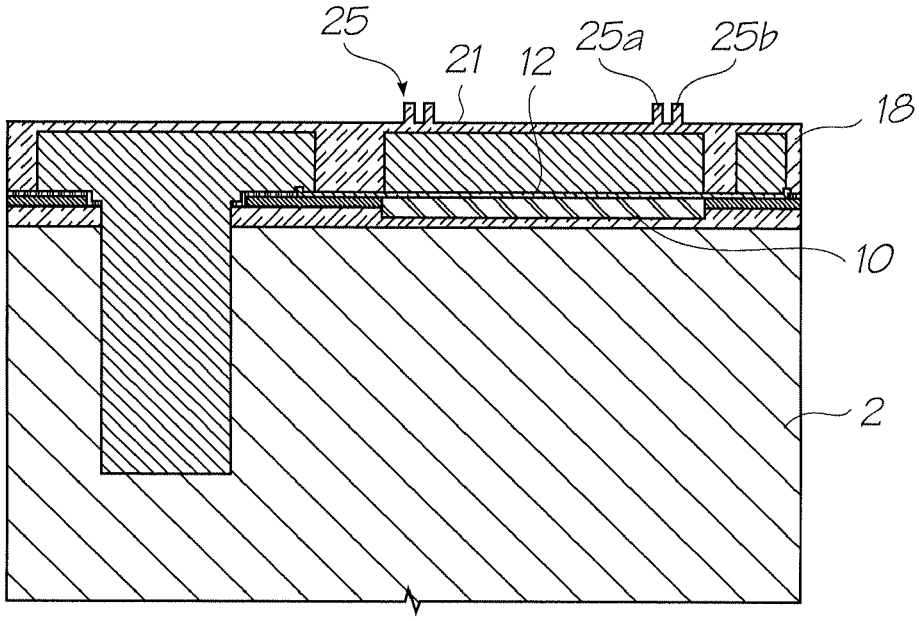
FIG. 29 shows the etch of the roof layer to form the nozzle aperture rim.
Figure 30:
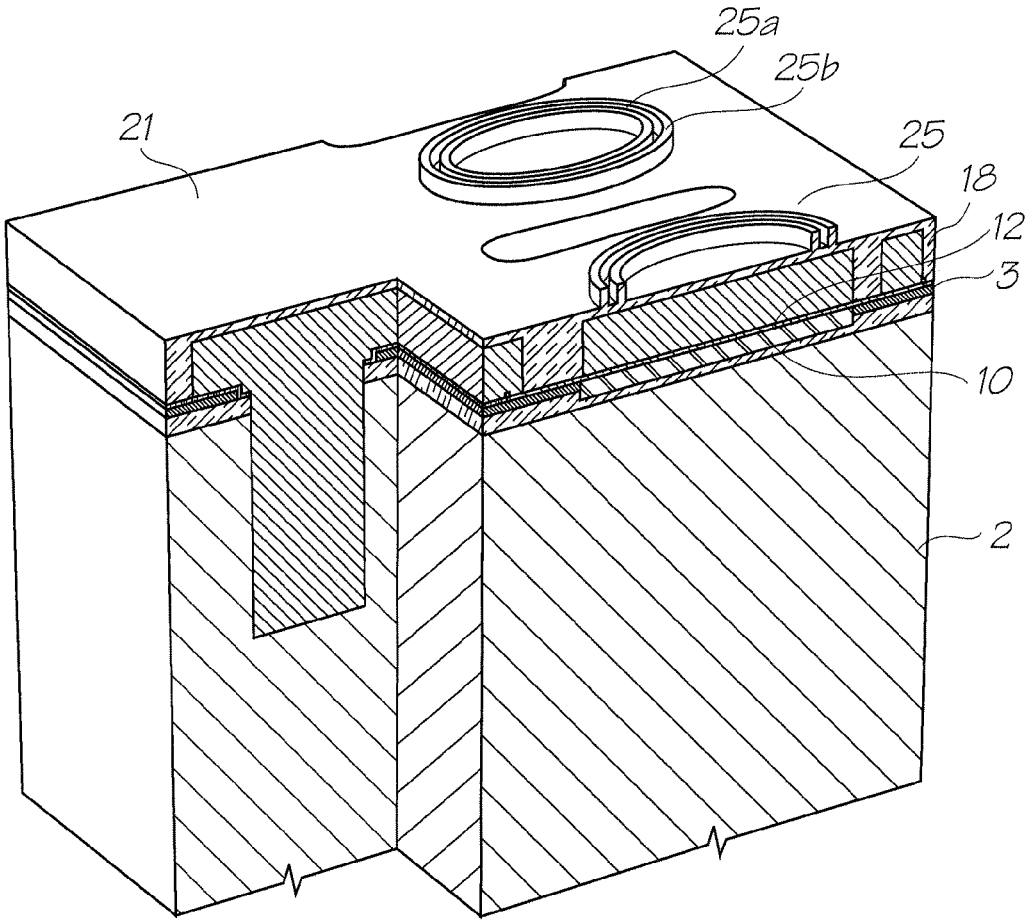
FIG. 30 is a perspective of the unit cell shown in FIG. 29.

Referring to FIGS. 28 to 30, the next stage defines an elliptical nozzle rim 25 in the roof 21 by etching away 2 microns of roof material 20. This etch is defined using a layer of photoresist (not shown) exposed by the dark tone rim mask shown in FIG. 28. The elliptical rim 25 comprises two coaxial rim lips 25*a* and 25*b*, positioned over their respective thermal actuator 12.

Figure 31:
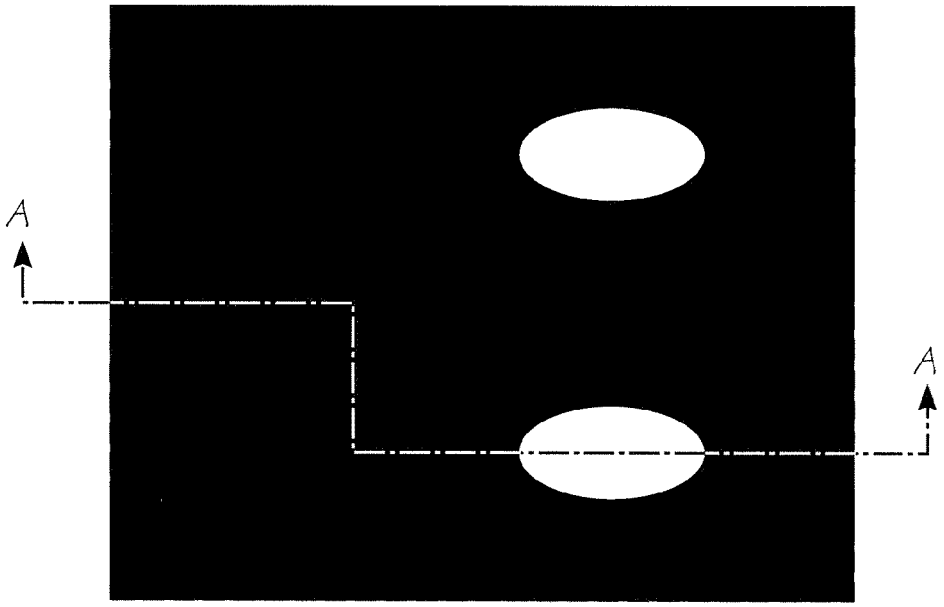
FIG. 31 is the mask associated with the nozzle aperture etch shown in FIG. 32.
Figure 32:
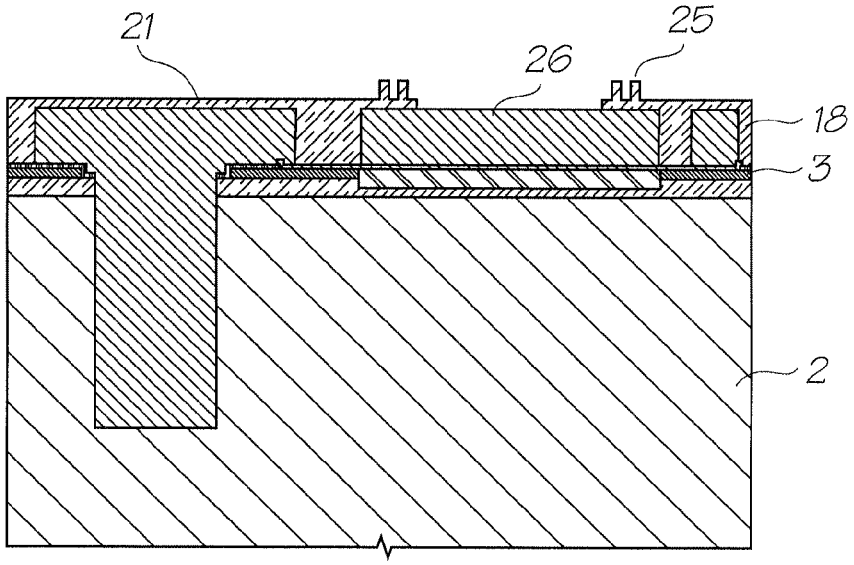
FIG. 32 shows the etch of the roof material to form the elliptical nozzle apertures.
Figure 33:
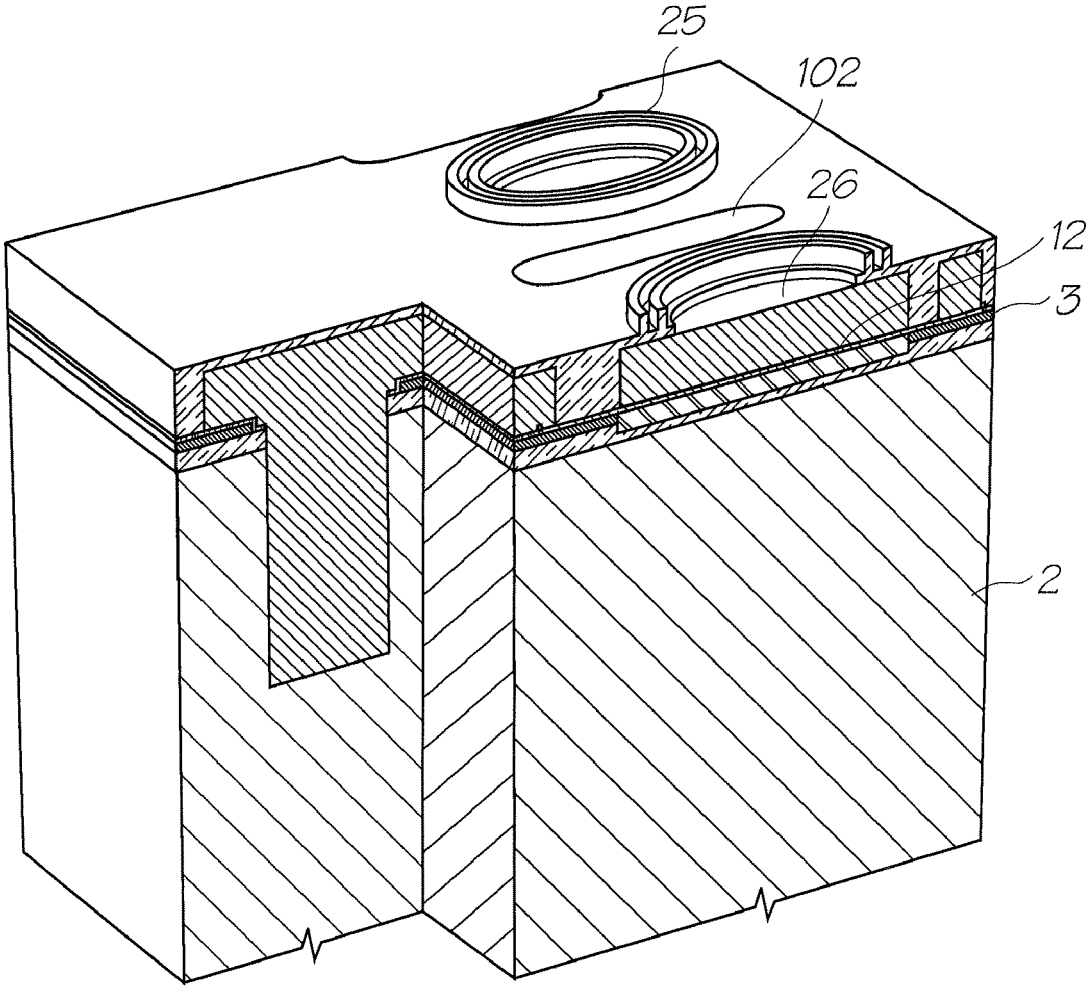
FIG. 33 is a perspective of the unit cell shown in FIG. 32.

Referring to FIGS. 31 to 33, the next stage defines an elliptical nozzle aperture 26 in the roof 21 by etching all the way through the remaining roof material 20, which is bounded by the rim 25. This etch is defined using a layer of photoresist (not shown) exposed by the dark tone roof mask shown in FIG. 31. The elliptical nozzle aperture 26 is positioned over the thermal actuator 12, as shown in FIG. 33.

Figure 34:
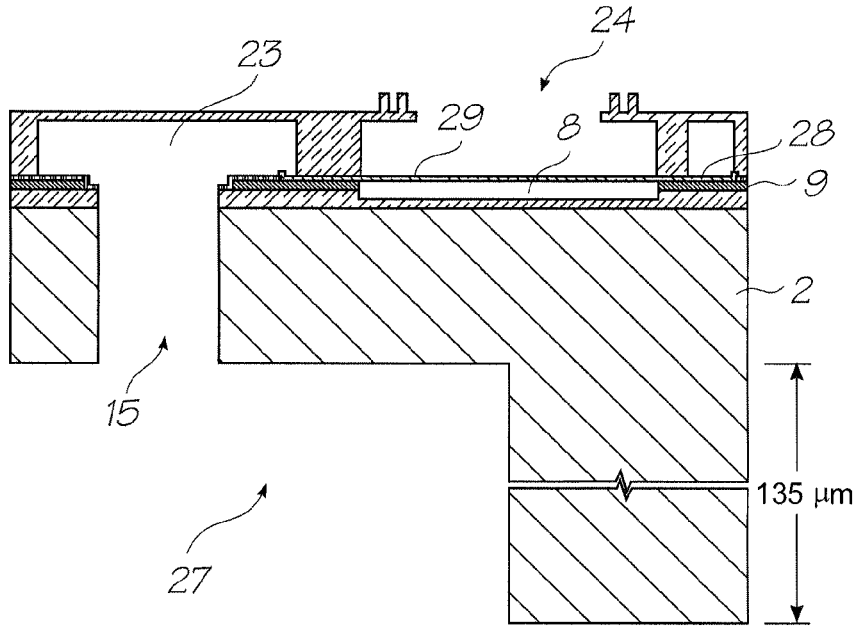
FIG. 34 shows the unit cell after backside etching, plasma ashing and wafer thinning.
Figure 35:
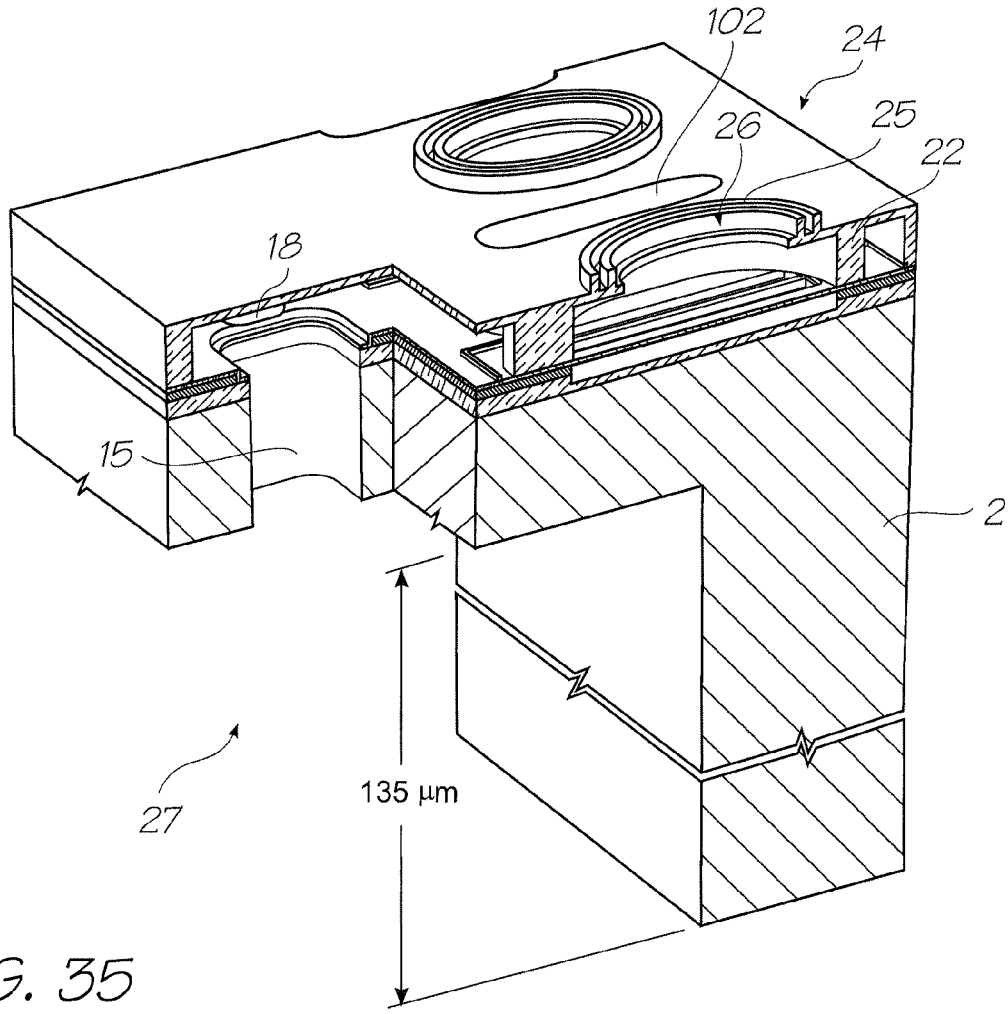
FIG. 35 is a perspective of the unit cell shown in FIG. 34.

With all the MEMS nozzle features now fully formed, subsequent stages define ink supply channels 27 by backside DRIE, remove all sacrificial photoresist (including the SAC1 and SAC2 photoresist layers 10 and 16) by $O_2$ plasma ashing, and thin the wafer to about 135 microns by backside etching. FIGS. 34 and 35 show the completed unit cell, while FIG. 36 shows three adjacent rows of nozzles in a cutaway perspective view of the completed printhead integrated circuit.

Alternative MEMS Manufacturing Process Providing Planar Nozzle Plate

One of the advantages of the MEMS manufacturing process described above is that the nozzle plate 101 is deposited by PECVD. This means that the nozzle plate fabrication can be incorporated into a MEMS fabrication process which uses standard CMOS deposition/etch techniques. Thus, the overall manufacturing cost of the printhead can be kept low. By contrast, many prior art printheads have laminated nozzle plates, which are not only susceptible to delamination, but also require a separate lamination step that cannot be performed by standard CMOS processing. Ultimately, this adds to the cost of such printheads.

However, PECVD deposition of the nozzle plate 101 has its own challenges. It is fundamentally important to deposit a sufficient thickness of roof material (e.g. silicon nitride) so that the nozzle plate is not overly brittle. Deposition is not problematic when depositing onto planar structures; however, as will be appreciated from FIGS. 24-27, deposition of roof material 20 must also form sidewalls 22 of nozzle chambers 24. The SAC2 scaffold 16 may have sloped walls (not shown in FIG. 24) to assist with deposition of roof material into sidewall regions 17. However, in order to ensure that chamber sidewalls 22 receive sufficient coverage of roof material 20, it is necessary to have at least some spacing in between adjacent nozzles. Whilst this internozzle spacing is advantageous from the point of view of roof deposition, the resulting roof 21 (and nozzle plate 101) inevitably contains a plurality of cavities 102 in between nozzles. As already discussed, these cavities 102 behave as traps for particulates and flooded ink, and therefore hinder printhead maintenance.

Figure 37:
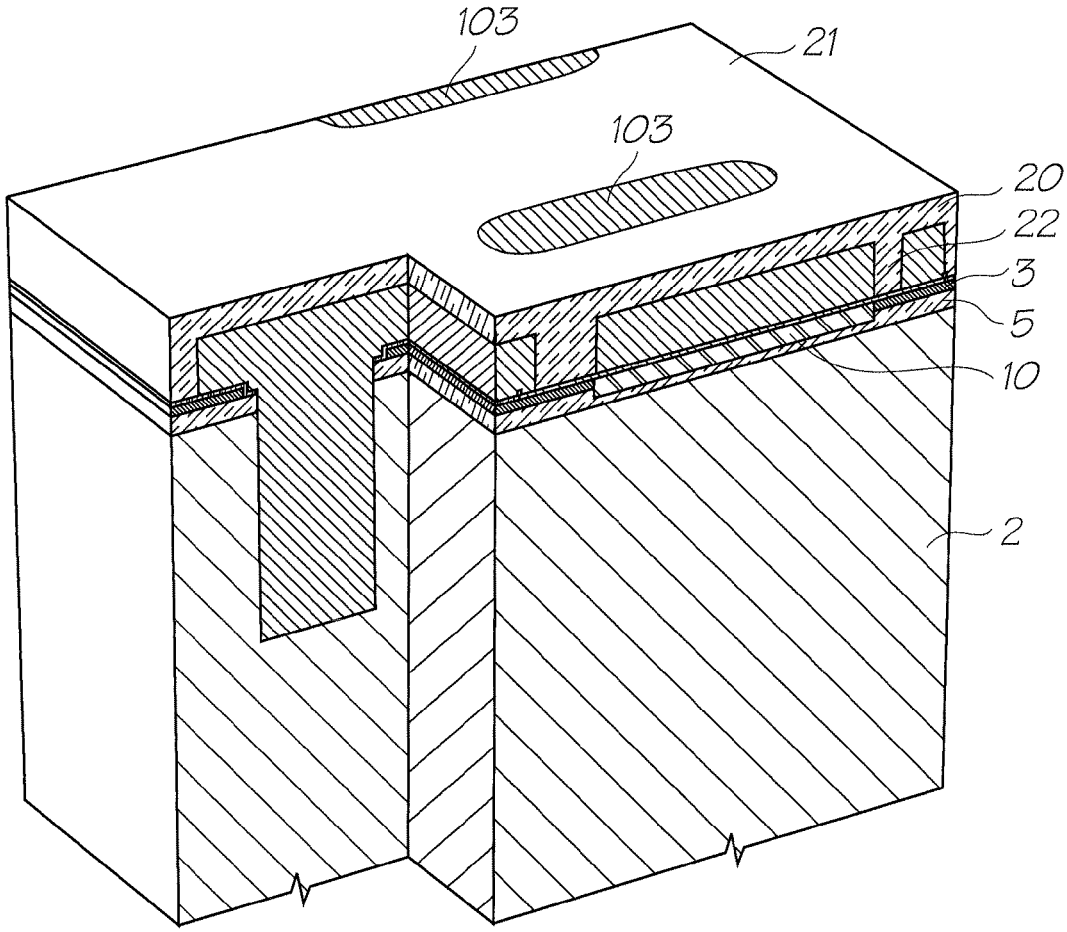
FIG. 37 is a perspective of the unit cell shown in FIG. 27 after cavity filling.

Referring now to FIGS. 37 to 40, there is shown an alternative MEMS manufacturing process, which minimizes some of the problems discussed above. At the stage of printhead fabrication shown in FIGS. 26 and 27, instead of proceeding immediately with nozzle rim and nozzle aperture etches, the roof 21 (which forms the nozzle plate 101) is first planarized. Planarization is achieved by depositing an additional layer of photoresist (e.g. about 10 microns thickness) onto the roof 21, which fills all the cavities 102. Typically, this photoresist is then thermally reflowed to ensure that the cavities 102 are completely filled. The layer of photoresist is then removed back to the level of the roof 21 so that the upper surface of the roof 21 and the upper surface of photoresist 103 deposited in the cavities 102 together form a contiguous planar surface. Photoresist removal can be performed by any suitable technique, such as chemical-mechanical planarization (CMP) or controlled photoresist etching (e.g. $O_2$ plasma). As shown in FIG. 37, the resultant unit cell has photoresist 103 completely filling the cavities 102.

Figure 38:
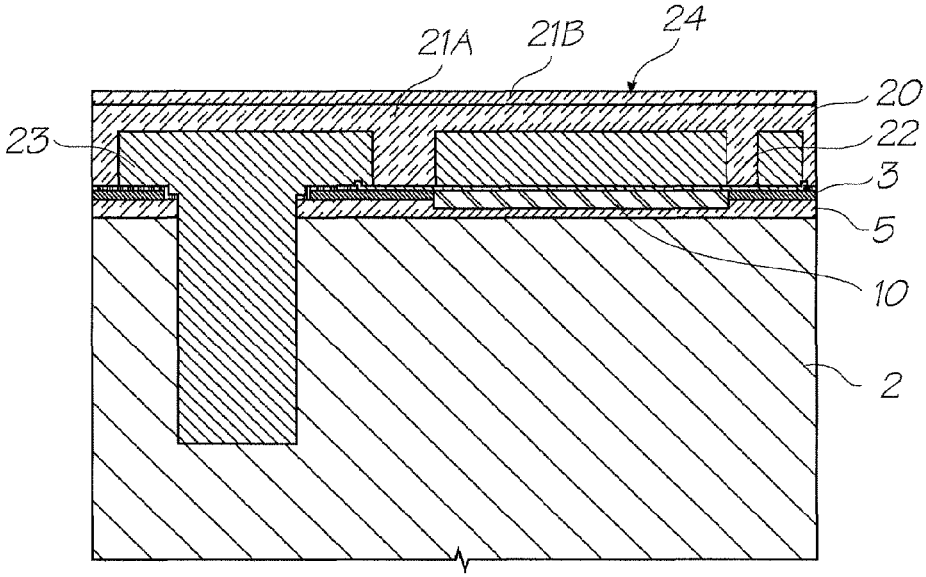
FIG. 38 is a side view of the unit cell shown in FIG. 37 after a second roof deposition.
Figure 39:
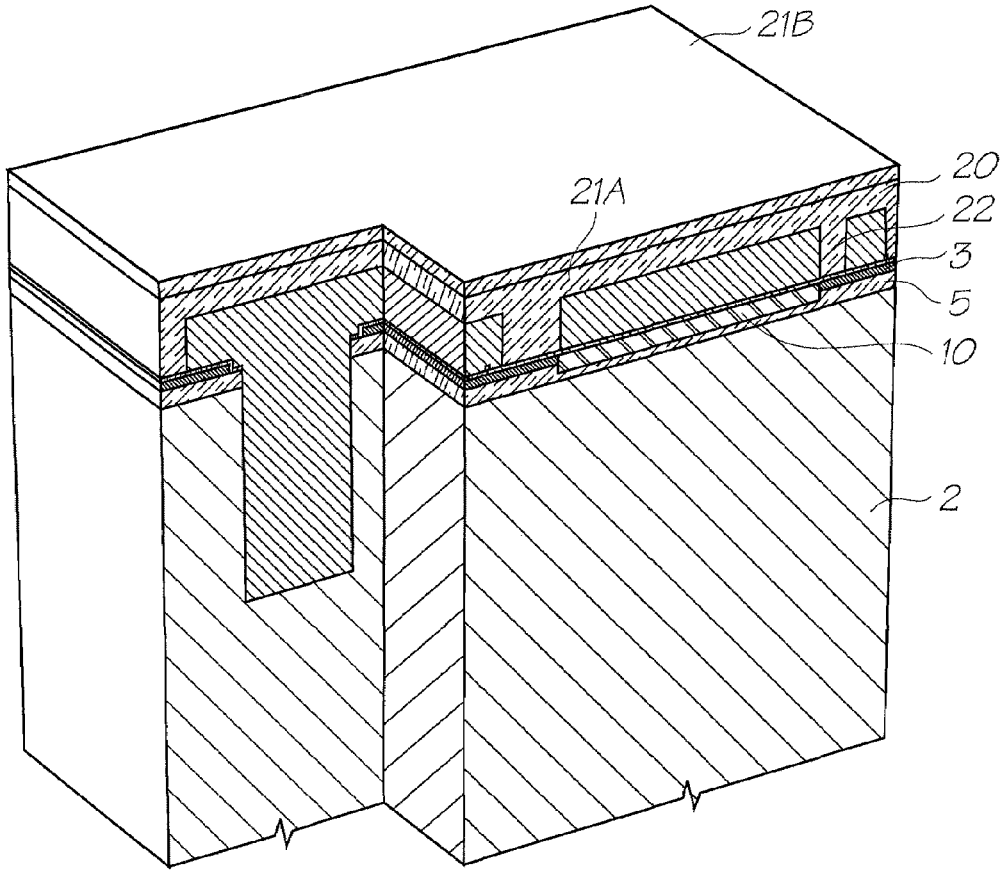
FIG. 39 is a perspective of the unit cell shown in FIG. 38.

The next stage deposits additional roof material (e.g. 1 micron thick layer) by PECVD onto the planar structure shown in FIG. 37. As shown in FIGS. 38 and 39, the resultant unit cell has a first roof 21A and a second roof 21B. Importantly, the exterior second roof 21B is fully planar by virtue of its deposition onto a planar structure. Furthermore, the second roof 21B is reinforced by the underlying photoresist 103 filling the cavities 102 in the first roof 21A.

This reinforced bi-layered roof structure is mechanically very robust compared to the single roof structure shown in FIG. 27. The increased thickness and internozzle reinforcement improves the general robustness of the roof structure. Furthermore, the planarity of the exterior second roof 21B provides improved robustness with respect to sheer forces across the roof.

The first and second roofs 21A and 21B may be comprised of the same or different materials. Typically, the first and second roofs are comprised of materials independently selected from the group comprising: silicon nitride, silicon oxide and silicon oxynitride. In one embodiment, the first roof 21A is comprised of silicon nitride and the second roof is comprised of silicon oxide.

Following on from the unit cell shown in FIGS. 38 and 39, subsequent MEMS processing can proceed analogously to the corresponding steps described in connection with FIGS. 28 to 36. Hence, nozzle rim and nozzle aperture etches are performed, followed by backside DRIE to define ink supply channels 27, wafer thinning and photoresist removal. Of course, the photoresist 103 encapsulated by the first and second roofs 21A and 21B is not exposed to any ashing plasma and remains in tact during late-stage photoresist removal.

Figure 40:
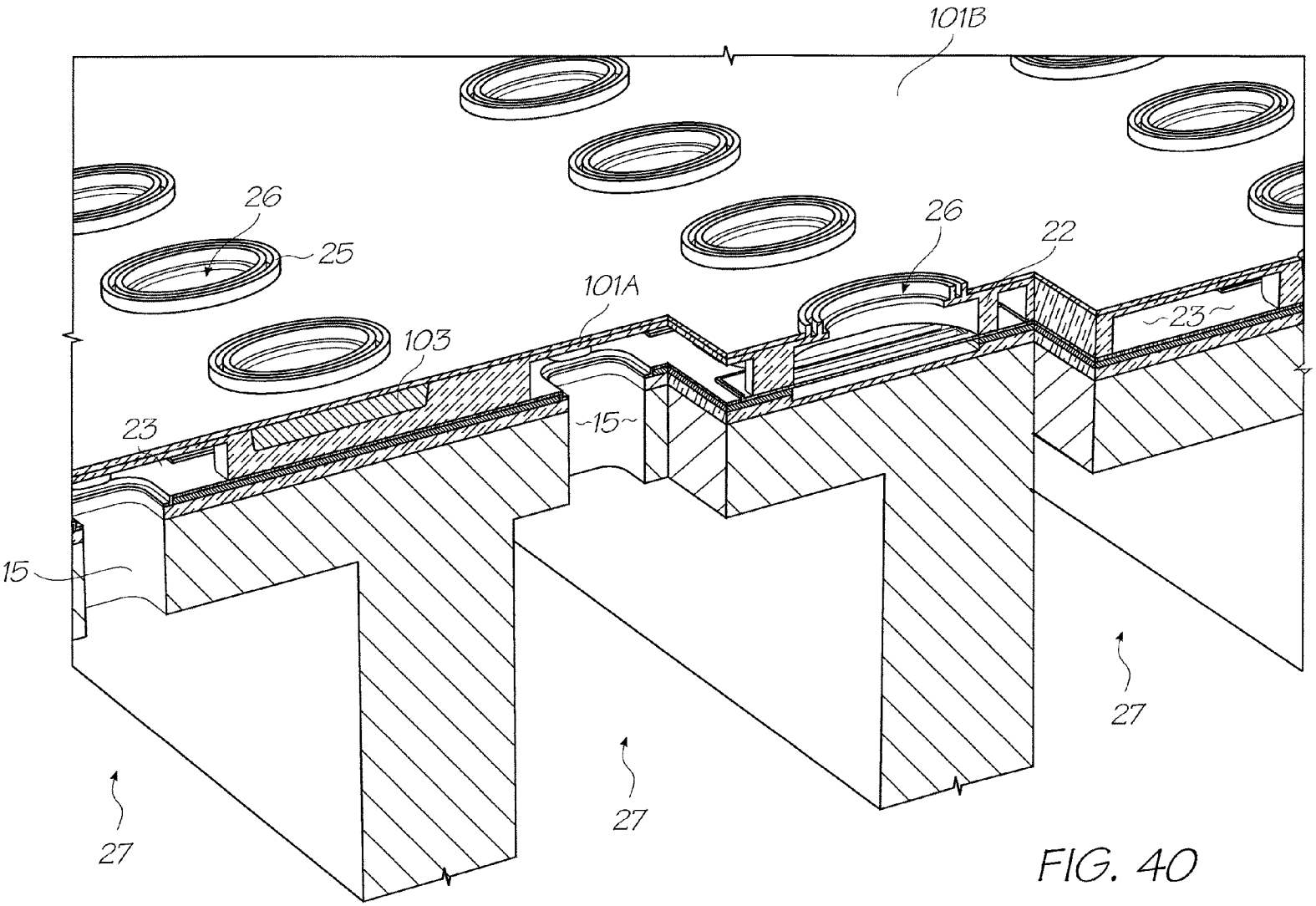
FIG. 40 is a cutaway perspective of a printhead integrated circuit with a reinforced bi-layered nozzle plate.

The resultant printhead integrated circuit, having a planar, bi-layered reinforced nozzle plate, is shown in FIG. 40. The nozzle plate comprises a first nozzle plate 101A and an exterior second nozzle plate 101B, which is completely planar save for the nozzle rims and nozzle apertures. This printhead integrated circuit according to the present invention facilitates printhead maintenance operations. Its improved mechanical integrity means that relatively robust cleaning techniques (e.g. wiping) may be used without damaging the printhead. Furthermore, the absence of cavities 102 in the exterior second nozzle plate 102B minimizes the risk of particulates or ink becoming trapped permanently on the printhead.

It will, of course, be appreciated that the present invention has been described purely by way of example and that modifications of detail may be made within the scope of the invention, which is defined by the accompanying claims.

The invention claimed is:

1. A method of fabricating an inkjet printhead having a planar nozzle plate, said method comprising the steps of:

(a) providing a partially-fabricated printhead having a first nozzle plate comprised of a first material spanning a plurality of nozzles, said first nozzle plate having a plurality of cavities which are not nozzles;

(b) filling completely each of said cavities with a filler, such that an upper surface of said first nozzle plate and an upper surface of said filler together define a contiguous planar surface; and (c) depositing a second material onto said planar surface to form a second nozzle plate having a planar exterior surface.

2. The method of claim 1, wherein said second material is deposited by PECVD.

3. The method of claim 1, wherein said first material is deposited by PECVD onto a non-planar sacrificial scaffold to form said first nozzle plate.

4. The method of claim 1, wherein said first and second materials are the same or different from each other.

5. The method of claim 1, wherein said first and second materials are independently selected from the group comprising: silicon nitride, silicon oxide and silicon oxynitride.

6. The method of claim 1, wherein said filler is photoresist.

7. The method of claim 6, wherein step (b) is performed by the sub-steps of:

(b)(i) depositing a layer of photoresist onto said first nozzle plate so as to fill said cavities; and (b)(ii) removing a portion of said photoresist such that an upper surface of said first nozzle plate and an upper surface of said photoresist filling said cavities together define a contiguous planar surface.

8. The method of claim 7, further comprising the step of: thermally reflowing said photoresist to facilitate complete filling of said cavities.

9. The method of claim 7, wherein step (b)(ii) is performed by chemical mechanical planarization or by photoresist etching.

10. The method of claim 1, further comprising the step of:

(d) defining nozzle apertures through said first and second nozzle plates.

11. The method of claim 1, wherein each nozzle comprises a nozzle chamber formed on a substrate, said nozzle chamber comprising a roof spaced apart from said substrate and sidewalls extending between said roof and said substrate, wherein said first nozzle plate and said sidewalls are comprised of the same material.

* * * * *